US009340354B2

(12) United States Patent
Fellenzer et al.

(10) Patent No.: US 9,340,354 B2
(45) Date of Patent: May 17, 2016

(54) FLUID CONTAINMENT APPARATUS

(71) Applicant: Brewer Steel Co., Greeley, CO (US)

(72) Inventors: Steven Fellenzer, Loveland, OH (US); Michael W. Ratcliff, Johnstown, CO (US)

(73) Assignee: Brewer Steel Co., Greeley, CO (US)

( * ) Notice: Subject to any disclaimer, the term of this patent is extended or adjusted under 35 U.S.C. 154(b) by 839 days.

(21) Appl. No.: 13/666,679

(22) Filed: Nov. 1, 2012

(65) Prior Publication Data

US 2014/0117011 A1 May 1, 2014

(51) Int. Cl.

*B65D 90/02* (2006.01)
*B65D 90/08* (2006.01)
*B65D 90/20* (2006.01)

(52) U.S. Cl.

CPC ..... *B65D 90/024* (2013.01); *B65D 90/08* (2013.01); *B65D 90/205* (2013.01)

(58) Field of Classification Search

CPC .. B65D 7/30; B65D 11/1826; B65D 21/0204; B65D 81/3818; B65D 88/005; B65D 88/08; B65D 88/12; B65D 88/121; B65D 88/524; B65D 88/528; B65D 90/08; B65D 90/023–90/024; B65D 90/20; B65D 90/24; B65D 90/205; E02D 25/00; E02D 27/38; E04B 1/34315; E04B 2/7431; E04B 2001/34389; E04H 4/0043; E04H 7/06; E04H 7/20; E04H 2004/146; F16B 5/0036; F16B 5/0048; Y10T 29/49826

USPC ..... 220/1.5–1.6, 23.4, 23.9, 4.12, 220/4.16–4.17, 4.28, 4.33, 4.34, 495.06, 220/495.08, 567, 666, 681, 692–693, 9.4; 292/4; 403/300, 306, DIG. 15; 52/248, 52/292, 155, 223.3, 245, 249, 5, 580, 52/587.1, 73, 848

See application file for complete search history.

(56) References Cited

U.S. PATENT DOCUMENTS 3,722,714 A * 3/1973 Morris ..... B65D 88/022 206/499
4,044,517 A * 8/1977 Schroter ..... B65D 90/06 220/592.24
8,365,937 B2 * 2/2013 Lovelace ..... B65D 90/205 220/4.12

(Continued)

*Primary Examiner* — Bryon Gehman
*Assistant Examiner* — Brijesh V. Patel
(74) *Attorney, Agent, or Firm* — Santangelo Law Offices, P.C.

(57) ABSTRACT

The inventive technology may include several independent inventive aspects relating to: attachment componentry and associated supports (such as flanges) that are used to create a tight, vandal resistant seal between adjacent panels of a fluid containment apparatus, and facilitate assembly of panels to form such apparatus, and facilitate disassembly thereof; strategic location of crane hook attachment components so as to avoid unwanted misorientation of a panel suspended at such components during containment apparatus construction; attachment componentry that include angled driven pin axes or provision of automatically self-seating upon pin driving of, e.g., protrusions in proper positions in corresponding apertures, where such proper positions may coincide with proper, tight sealing relative positions of adjacent, attached panels and enhance installed apparatus stability.

42 Claims, 29 Drawing Sheets

(56) References Cited

U.S. PATENT DOCUMENTS 8,534,480 B1 * 9/2013 Hanna ..... B65D 90/08 220/4.16
8,800,234 B2 * 8/2014 Taillefer ..... B65D 88/08 220/682
2011/0194893 A1 * 8/2011 Wiebe ..... B65D 7/06 403/300
2012/0152960 A1 * 6/2012 Toews ..... E04H 7/065 220/565
2012/0223073 A1 * 9/2012 Lovelace ..... B65D 90/205 220/4.28
2013/0333195 A1 * 12/2013 Hanna ..... B65D 90/08 29/525.01
2014/0048532 A1 * 2/2014 Noles, Jr. ..... B65D 90/205 220/4.17

* cited by examiner

FLUID CONTAINMENT APPARATUS

BACKGROUND OF THE INVENTION

Fluid containment structures have been used for centuries. Multi-panel units that may allow for on-site erection of a structure as an application demands have found particular use in various industries requiring storage of large amounts of fluid (several hundred or several thousand gallons, or even larger), whether water, aqueous solution, chemical solution, well related fluids, mining related fluids or brine (to name just a few) or otherwise. Whether such containment is achieved via use of liner that is placed internally of the structure or not, and whether such unit includes a bottom floor (or instead uses the underlying ground surface as support for the contained fluid), modular units may enable shipping savings as compared with structures that are not modular or assemblable on-site, and may enable structure disassembly and reuse elsewhere. Indeed, modular units, which enable assembly on-site from a plurality of structure components, may offer significant advantages relative to permanent structures.

However, conventional structures are not without their disadvantages, including difficult, time-consuming, labor intensive structure erection and disassembly, vulnerability to damage (e.g., of the contained fluid liner) by vandals, high apparatus expense, and/or sub-optimal functionality (e.g., creep induced leakage). Some applications, such as containment of fracking fluids (hydraulic fracturing as used in the natural gas or other mining industry) or other well-related fluids may, because of opposition from certain individuals or groups that are against mining technologies and operations such as fracking also, be subject to vandalistic attempts to impair the fluid tanks. One type of vandalism that lined fracking fluid tanks have suffered is piercing of the contained liner by forcing of a knife or other pointed object through areas of vulnerability (e.g., seams) between adjacent panels. Of course, such vandalism can be expensive and result in operation slow-down or shutdown until costly repairs are made. Particular embodiments of the inventive technology disclosed herein attempt to resolve or abate one or more of these problems.

BRIEF SUMMARY OF THE INVENTION

The inventive technology may include several independent inventive aspects relating to: attachment componentry and associated supports (such as flanges) that are used to create a tight, vandal resistant seal between adjacent panels of a constructed containment apparatus, and facilitate assembly of panels to form that apparatus, and facilitate disassembly thereof; strategic placement of apertures and associated components such as protrusions and retreating flanges in a manner that is sufficient to meet demands imposed by contained fluid pressure but not so much greater that material and fabrication costs are unnecessarily excessive; strategic location of crane hook attachment components so as to avoid unwanted misorientation of a panel suspended thereby during containment apparatus construction; attachment componentry that include angled driven pin axes and provision of automatically self seating upon driving of pins, of, e.g., protrusions in proper positions in corresponding apertures, where such proper positions may coincide with tight seal, relative positions of adjacent, attached panels. Of course, other inventive aspects may be disclosed elsewhere in this disclosure. Full descriptions may be as appear in the "Detailed Description of the Invention" and other sections, including the Drawings filed herewith as part of this application.

Particular embodiments of the inventive technology may seek to increase the efficiency of on-site, in the field installation/construction of fluid containment apparatus, in particular by increasing the speed of construction, thereby reducing costs.

Particular embodiments of the inventive technology may seek to make vandalism—particularly vandalism that seeks to pierce a liner inside of the attached fluid containment panels—more difficult, if not impossible (i.e., reduced vulnerability to vandalistic damage).

Particular embodiments of the inventive technology may seek to provide a field constructed, multi-panel-type fluid containment apparatus that is more stable and stronger than conventional field constructed, multi-panel-type fluid containment apparatus.

Particular embodiments of the inventive technology may seek to provide a field constructed multi-panel-type fluid containment apparatus that has driven pin axes that are angled so as to increase the speed of construction.

Particular embodiments of the inventive technology may seek to provide a field constructed multi-panel-type fluid containment apparatus that has exceptionally tight seals between adjacent panels.

Particular embodiments of the inventive technology may seek to provide a fluid containment structure capable of on-site assembly and disassembly, with an increased tightness of joints between adjacent panels, and increased precision of relative location of components that form and/or effect such joint.

Particular embodiments of the inventive technology may seek to provide a field constructed multi-panel-type fluid containment apparatus that, upon driving of pins, may "automatically" achieve a proper orientation, resulting in a stable relative positioning of installed configuration adjacent panels.

Particular embodiments of the inventive technology may seek to provide a field constructed multi-panel-type fluid containment apparatus that achieves increased speed of construction, stability after installation and/or tightness of seal via angled (when viewed form above) flanges of adjacently installed panels.

Particular embodiments of the inventive technology may seek to provide a field constructed multi-panel-type fluid containment apparatus that involves coordination (e.g., positioning) of attachment componentry (in the vertical axis) in a manner that conserves such componentry while achieving conventional or improved strength.

Particular embodiments of the inventive technology may seek to provide a field constructed multi-panel-type fluid containment apparatus that includes crane hook attachment components that are strategically selected in order that, during suspension of a panel during installation, such suspended panel is in an orientation that corresponds with already installed panels (e.g., side panel edges are vertical and top and lower panel edges are each in a respective horizontal plane).

Particular embodiments of the inventive technology may seek to reduce the costs of the apparatus components.

Particular embodiments of the inventive technology may seek to provide a field constructed multi-panel-type fluid containment apparatus that is dimensioned to enable stacking of panels (such that those panel sides that are vertical during installation are horizontal during stacking) in an stable manner. Such stacking may result in panel transport and storage cost savings.

Of course, other advantages, goals and/or objectives of the inventive technology may be mentioned or alluded to elsewhere in this disclosure.

It is of note that these goals/advantages may be achieved in any one or more of the following inexhaustive list of potential applications of the inventive technology: outdoor pools, fluid storage generally, well-related fluid storage; well related injection fluid storage; fracking fluid storage; on-site field storage of fluid; slurry (a type of fluid) storage; oil (another type of fluid) storage; liquid chemical solution storage generally; water impoundment generally (e.g., damming or reservoir related application), as but a few of many different examples.

DETAILED DESCRIPTION OF THE INVENTION

Figure 1B:
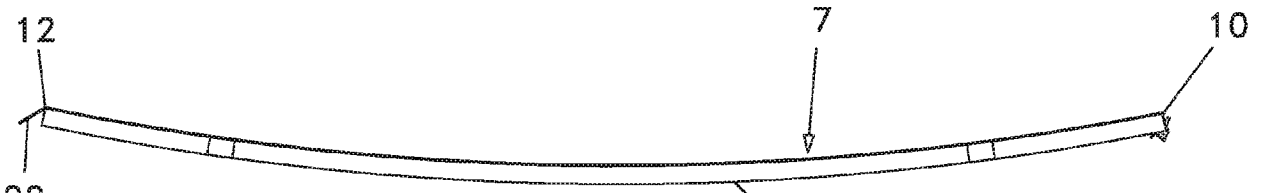
FIG. 1B shows a side, external view of at least one embodiment of an inventive panel.

As mentioned earlier, the present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

At least one embodiment of the inventive technology may be described as a fluid containment apparatus 5 that comprises a plurality of panels 6 for side-to-side attachment. The apparatus, during operation thereof, may comprise: a first panel 7, a second panel 8 and a third panel 9 (among other panels). The first panel may be established between the second panel and the third panel, and may contact the second panel at a sealing, first panel, second panel contact surface (or a first sealing contact surface) 10 on a second panel side 11 of the first panel, and may contact the third panel at a sealing, first panel, third panel contact surface (or a second sealing contact surface) 12 on a third panel side 13 of the first panel. Note that at times, an intermediate component (e.g., a vertical strip of rubber) may be used as a contact surface; in such cases, such component may be considered a part of a panel.

Figure 26:
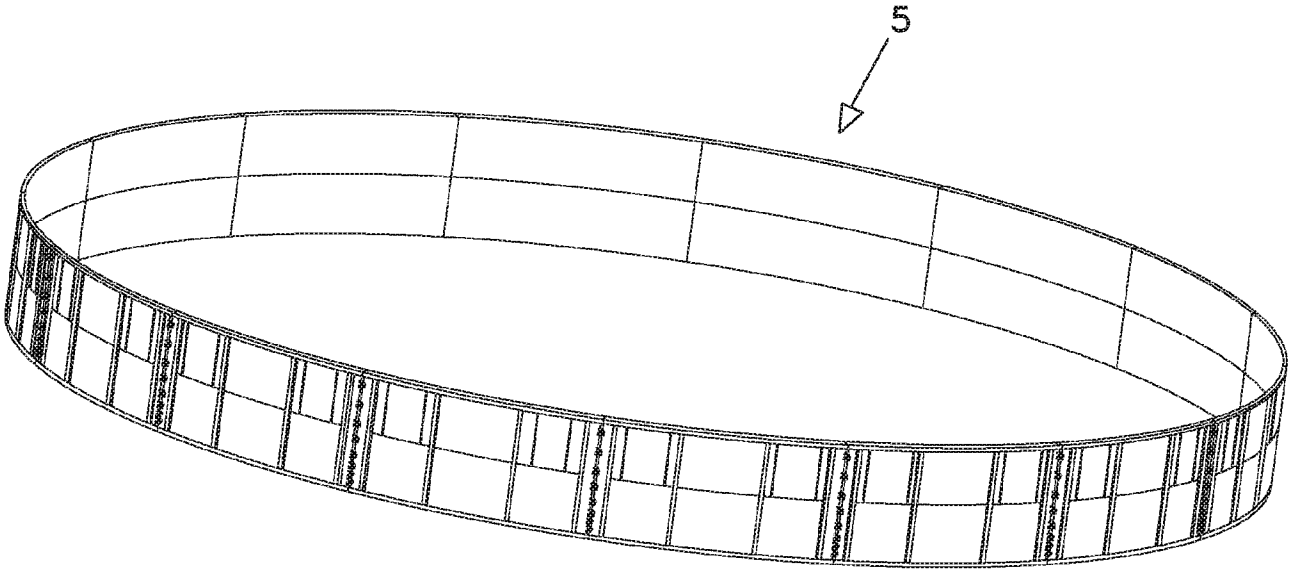
FIG. 26 shows a 16 panel annular fluid containment apparatus as found in at least one embodiment of the inventive technology.

It is of note that the apparatus need not (and often does not) include a bottom floor (see, e.g., FIG. 26). Many applications simply use a liner (that is to be placed in the apparatus upon completion of its construction) that lines the interior surface of the vertical panels and that includes a bottom that rests on the underlying ground surface. As such, the fluid containment apparatus may, at times, not be designed to contain fluids without the use of accompanying components (e.g., an interior liner). Nonetheless, either apparatus—with or without a liner, with or without a non-earth/non-ground bottom support—is termed a fluid containment apparatus. Accordingly, the inventive technology includes those apparatus with bottom flooring and without, and with or without a liner, and the term tank includes all such types of apparatus.

Figure 3:
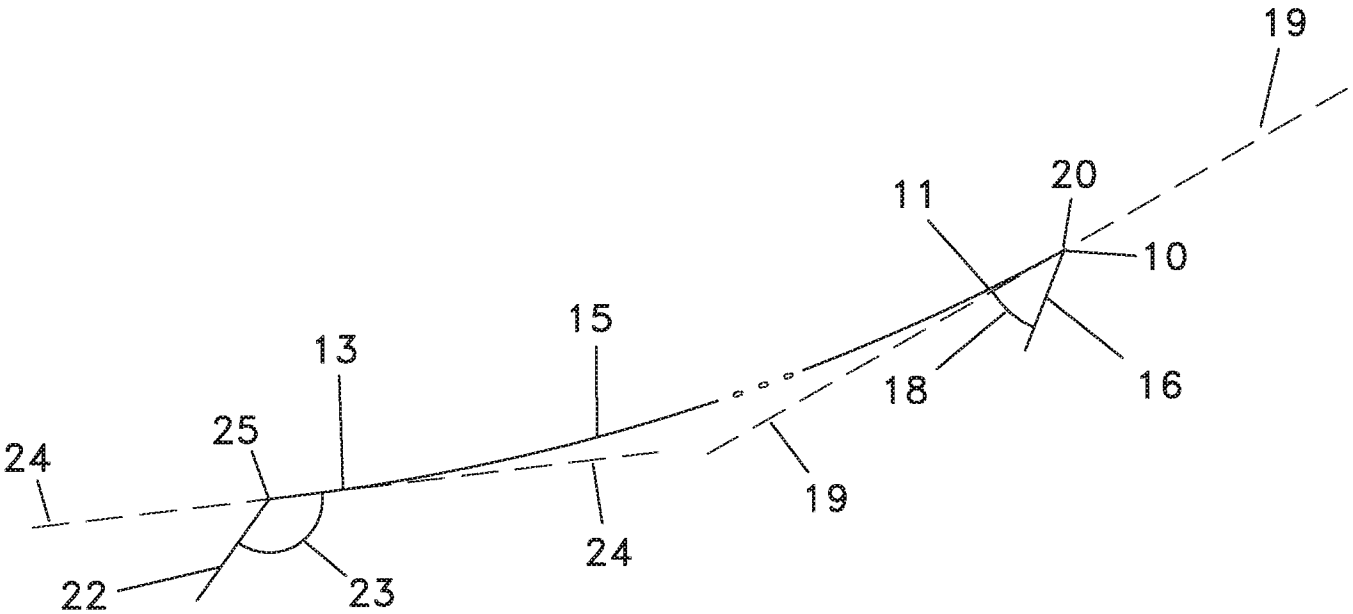
FIG. 3 shows a skeleton view from above, of at least one embodiment of an inventive panel.
Figure 4B:
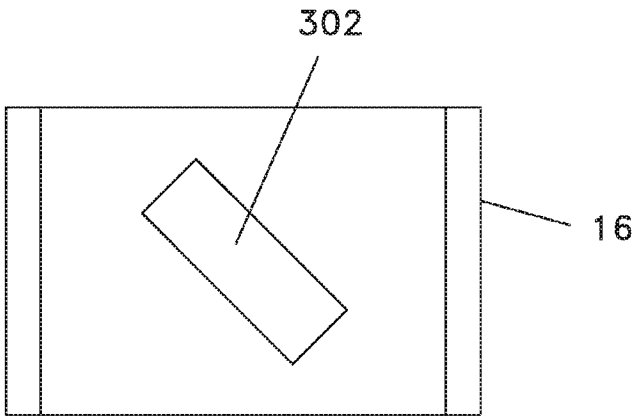
FIG. 4B shows a view from the side of at least one embodiment of a flange that finds use in certain inventive panels as that flange would present in a constructed containment apparatus.
Figure 4D:
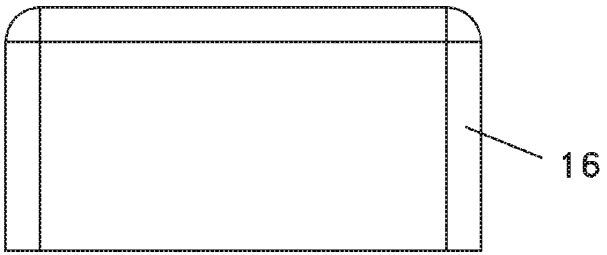
FIG. 4D shows a back side view from the perspective of a panel to which the flange may be attached (e.g., via welding) of a flange that finds use in certain embodiments of the inventive panel.
Figure 4A:
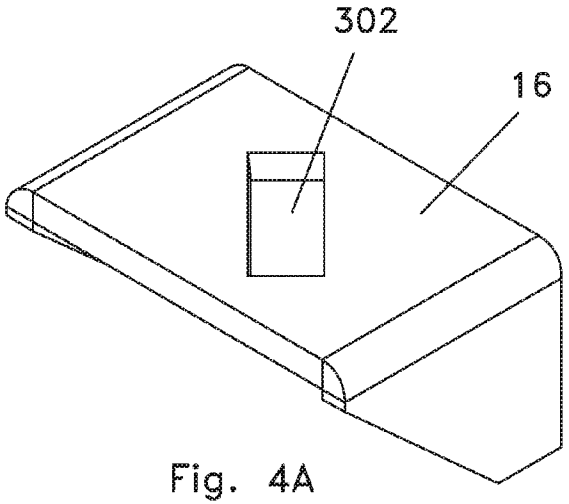
FIG. 4A shows a perspective view of at least one embodiment of a flange that finds use in certain inventive panels.
Figure 4C:
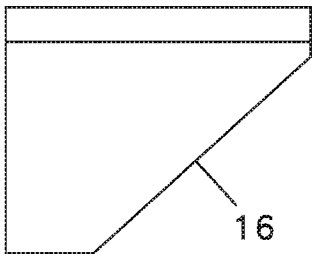
FIG. 4C shows a view from above (or below) of at least one embodiment of a flange that finds use in certain inventive panels as that flange would present in a constructed containment apparatus.
Figure 5:
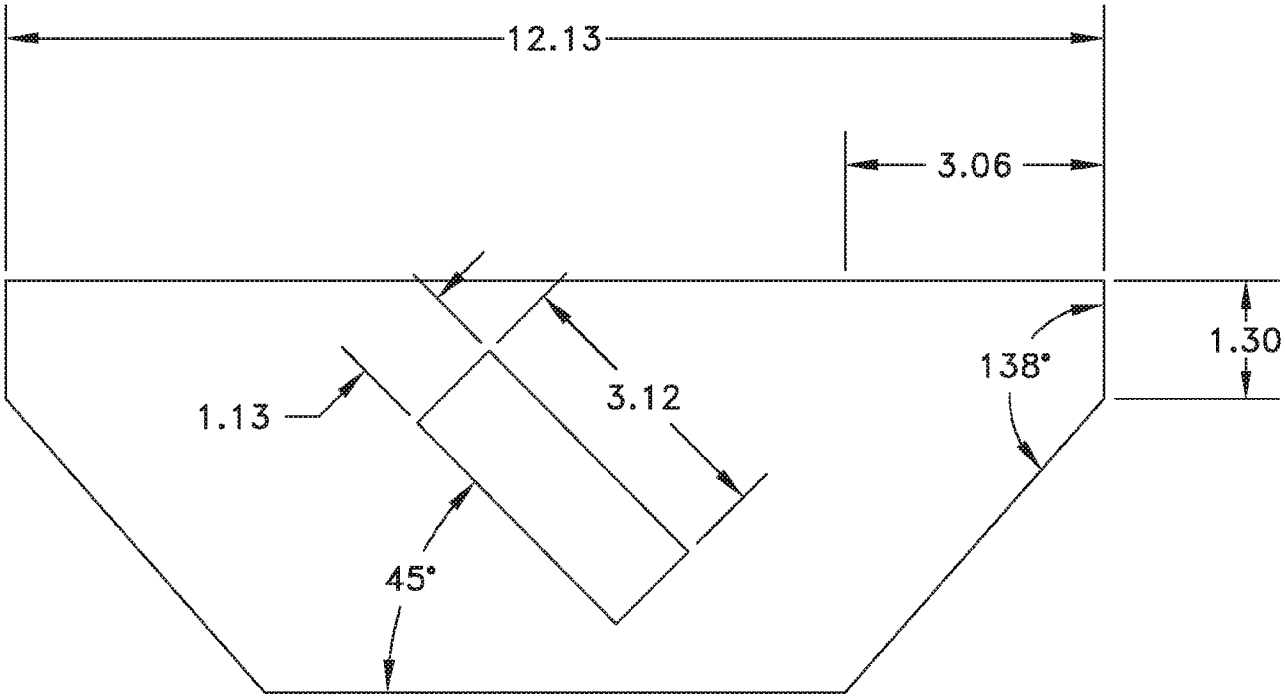
FIG. 5 shows a top view of a flat piece of metal, with possible dimensions, used to form at least one embodiment of a flange that finds use in certain embodiments of the inventive panel. All dimensions indicated in these figures are merely exemplary.
Figure 6:
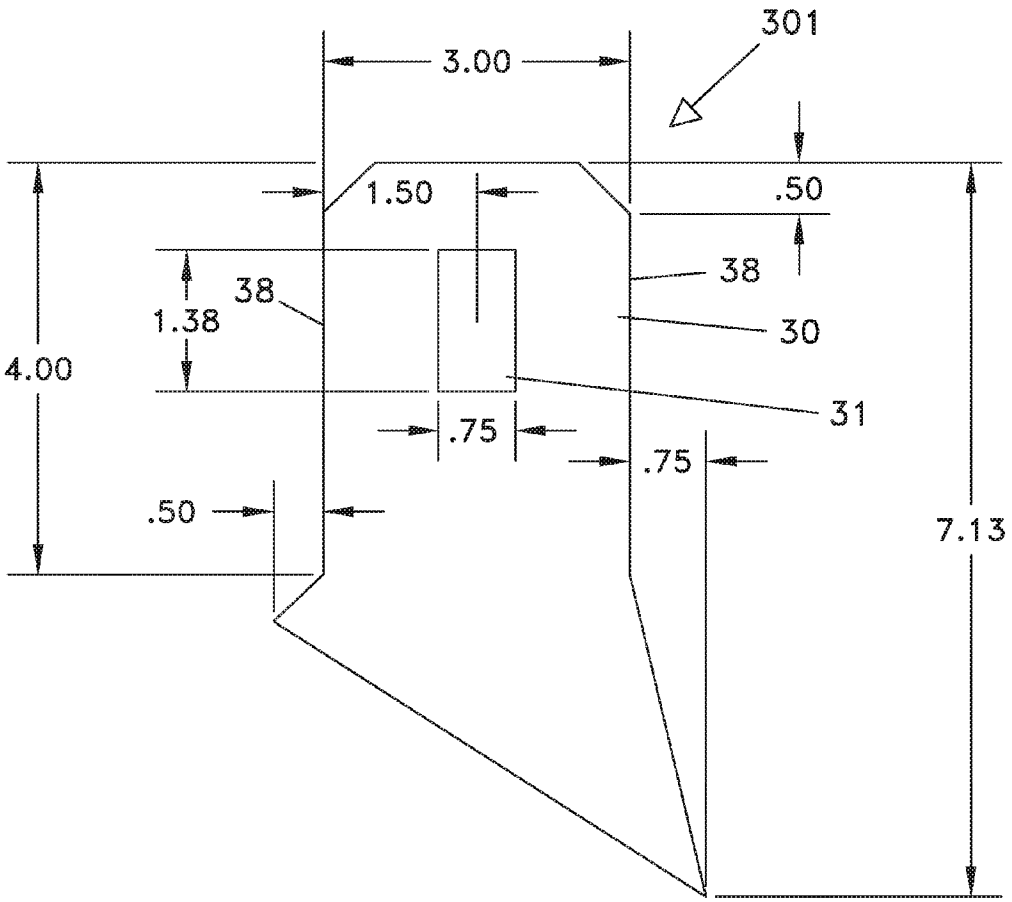
FIG. 6 shows a side view of a protrusion body (e.g., a lug) that finds application as attachment componentry (and that is established through an aperture in a retreating flange in at least one embodiment of the inventive technology.
Figure 7:
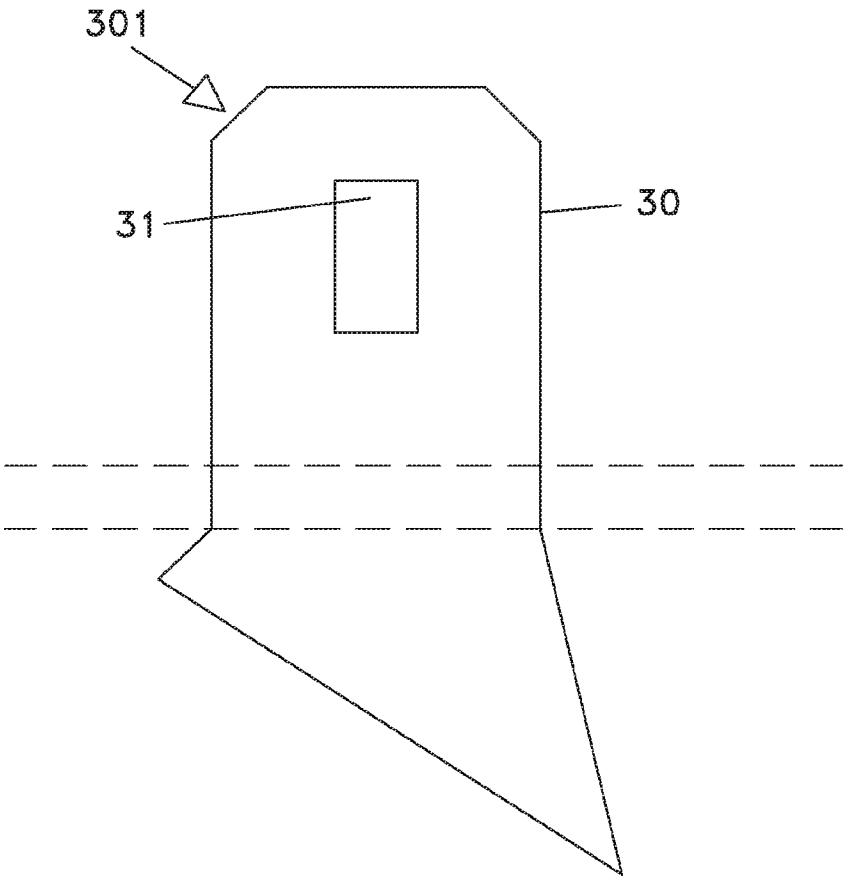
FIG. 7 shows a side view of a protrusion body that finds application as attachment componentry (and that is established through an aperture in a retreating flange in at least one embodiment of the inventive technology. The retreating flange material through which the protrusion body may pass is shown with the dashed lines.
Figure 8:
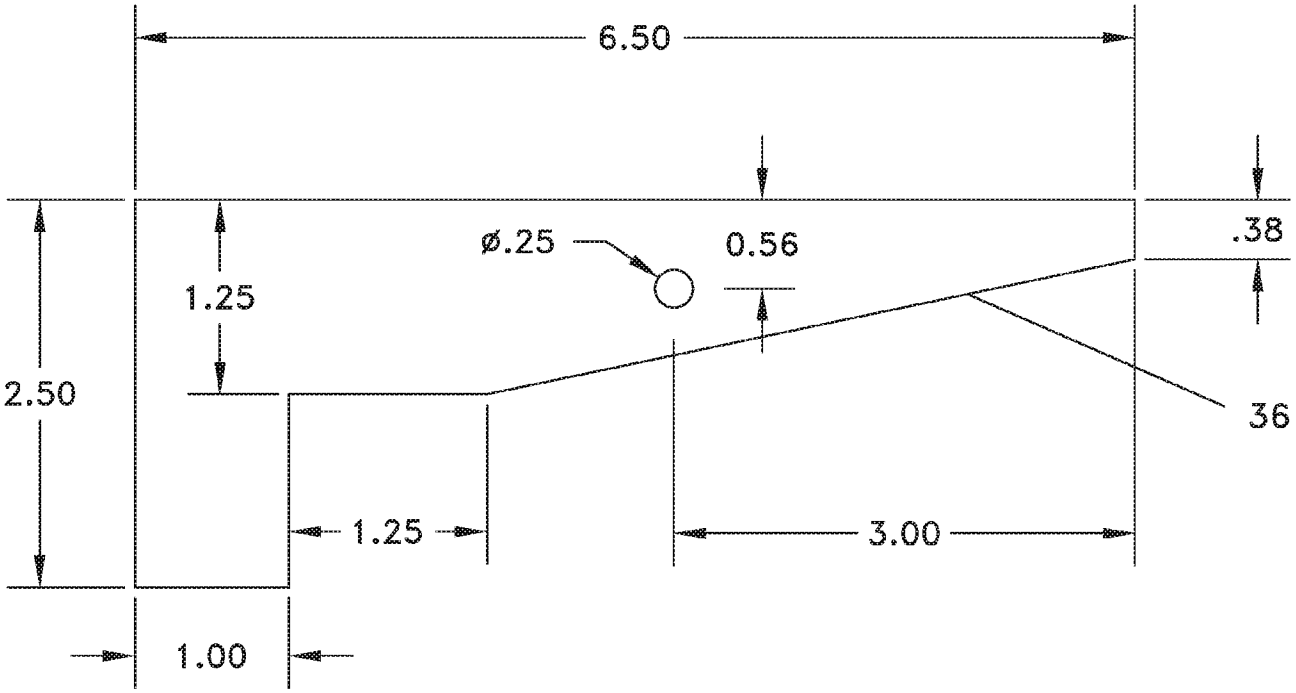
FIG. 8 shows a side view of a pin that may be driven through a first aperture passing through the protrusion in at least one embodiment of the inventive technology. A cotter pin or other type of securing pin may be established through the hole in the pin after it is driven, to help to prevent unintended dislodging of the pin.

The first panel may comprise a first panel fluid containment component 15 substantially between the sealing, first panel, third panel contact surface and the sealing, first panel, second panel contact surface, in addition to at least one retreating flange 16 that forms a part of the first panel and that is established at the second panel side thereof (the second side may be defined as the side where the retreating flange(s) is). The term flange is a broad term that includes but is not limited to a rib, edge, attachment site, or protrusion generally. Any structure that establishes or supports attachment componentry (e.g., protrusions, or corresponding apertures), perhaps as designed and indicated herein, whether via welding or "part-through-aperture" fitting, or in any other fashion, is deemed a flange. The term retreating, in opposition to the term advancing, suggests that the flange is angled back towards the vertical center of the panel (advancing indicates angling forward, away from the vertical center of the panel). The at least one retreating flange may define (and as shown in exemplary fashion in FIG. 3), in a horizontal plane, a first angle 18 relative to a first panel side of a tangent line 19 passing through a fluid proximate portion 20 of the sealing, first panel, second panel contact surface; the first angle may be an acute angle of x degrees. Note that the term tangent doesn't necessarily imply that the shape of the part that the referenced line passes through (i.e., where it glancingly contacts at a single point) is circular, curved or arcuate; it may be even straight in at least some portion. The first panel may further comprise at least one advancing flange 22 that forms a part of the first panel and that is established at the third panel side thereof; the at least one advancing flange may define, in a horizontal plane, a second angle 23 relative to a first panel side of a tangent line 24 passing through a fluid proximate portion 25 of the sealing, first panel, third panel contact surface. The second angle may be an obtuse angle of at most 180 degrees minus the aforementioned x degrees. The acute angle of x degrees may comprise an angle selected from the group consisting of substantially 40 degrees, substantially 38 degrees, substantially 35 degrees, substantially 32 degs, substantially 30 degrees and substantially 28 degrees. Of course, these are simply a few possible examples of the angle. Note that, in certain embodiments/designs, the contact surfaces may be only as large as, or only slightly larger than, fluid proximate portions thereof. In other designs, the contact surfaces may be a greater portion (perhaps even all) of the fully horizontal depth of one or even both of the interfacing flanges.

Figure 9:
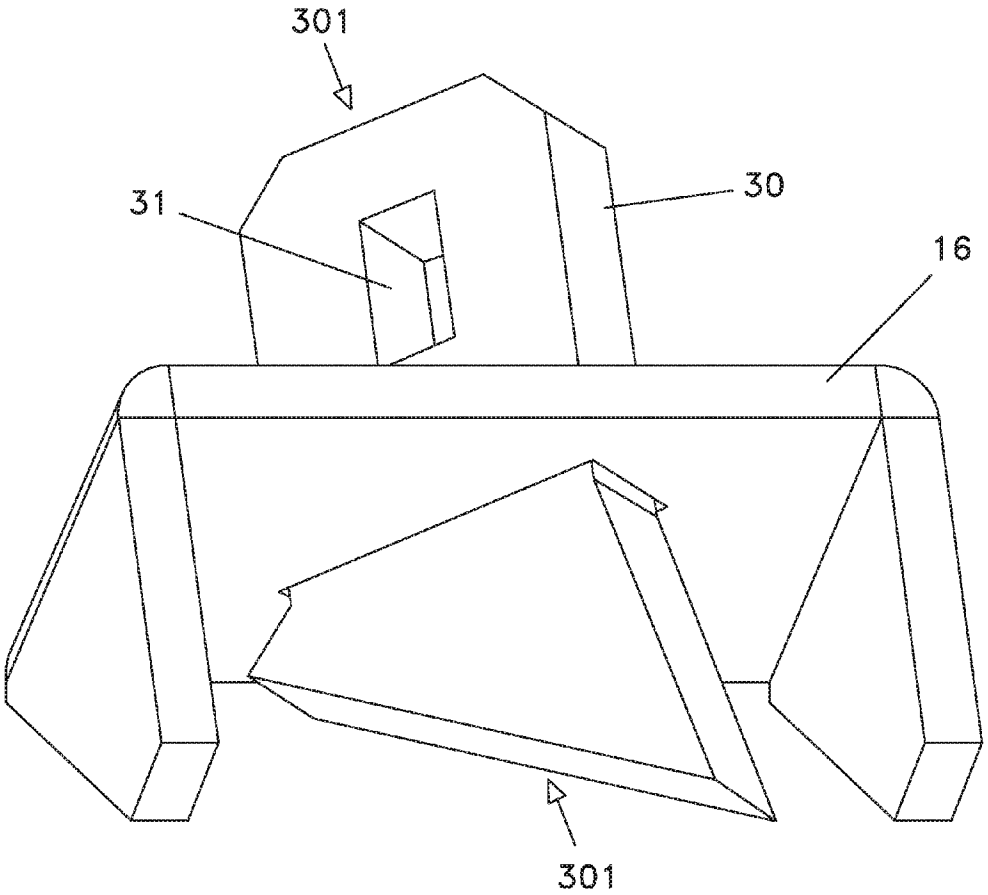
FIG. 9 shows a perspective view of a protrusion body established in a retreating flange in at least one embodiment of the inventive technology.
Figure 10:
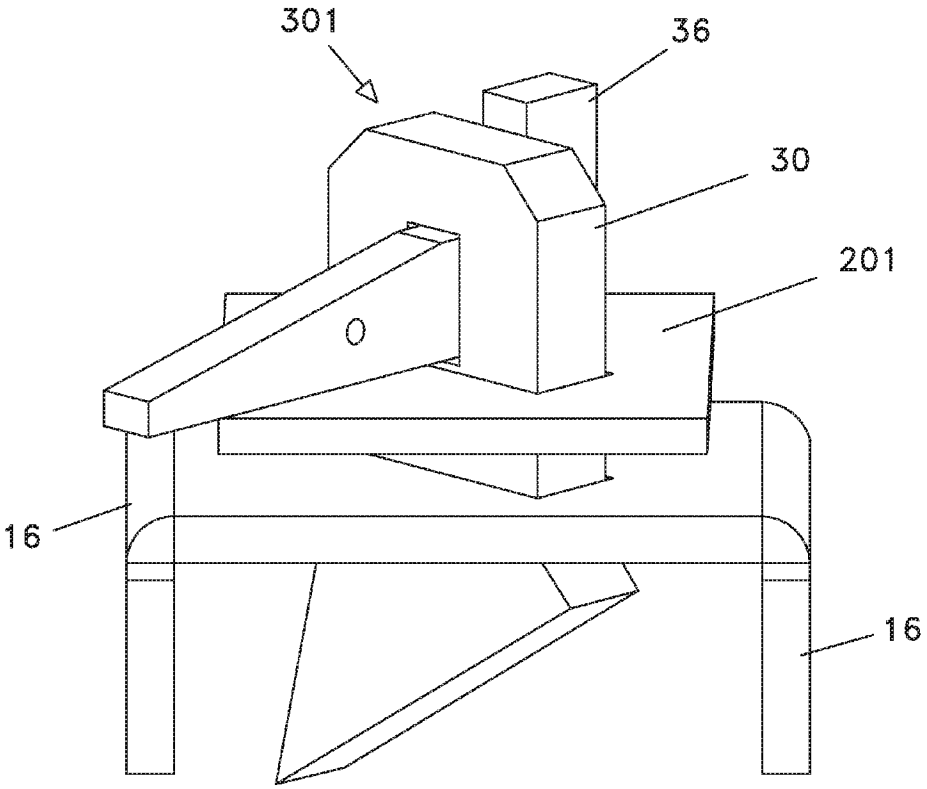
FIG. 10 shows a perspective view of a protrusion body established in a retreating flange and secured with a pin above a washer 201 in at least one embodiment of the inventive technology (note that the advancing flange that is established between the washer and the outer face of the retreating flange in at least one embodiment of the inventive technology is not shown in this figure, for clarity reasons).
Figure 11:
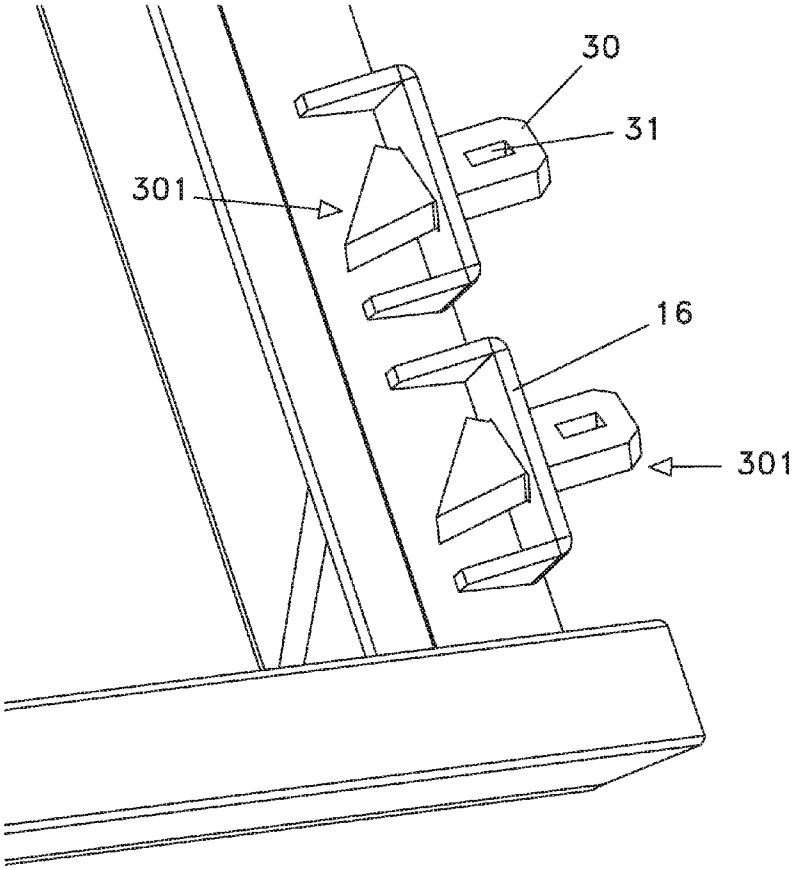
FIG. 11 shows a perspective view of a protrusion body established in a retreating flange, and the associated panel, in at least one embodiment of the inventive technology.
Figure 12:
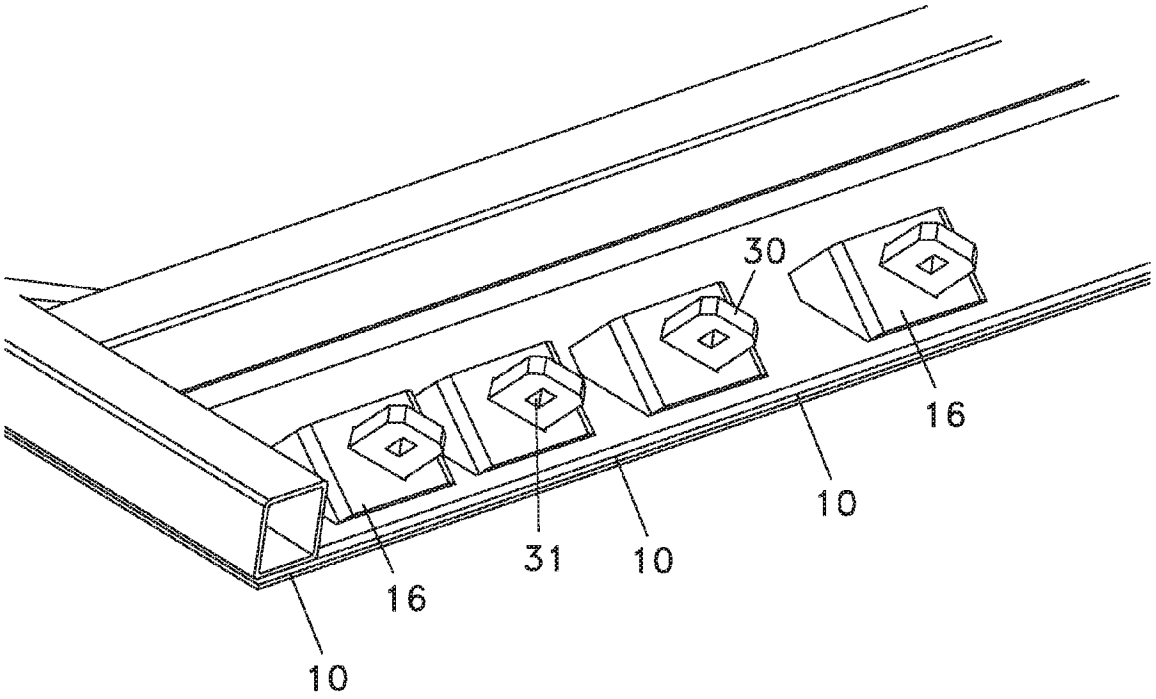
FIG. 12 shows another perspective view of a protrusion body established in a retreating flange, and the associated panel, in at least one embodiment of the inventive technology.
Figure 13:
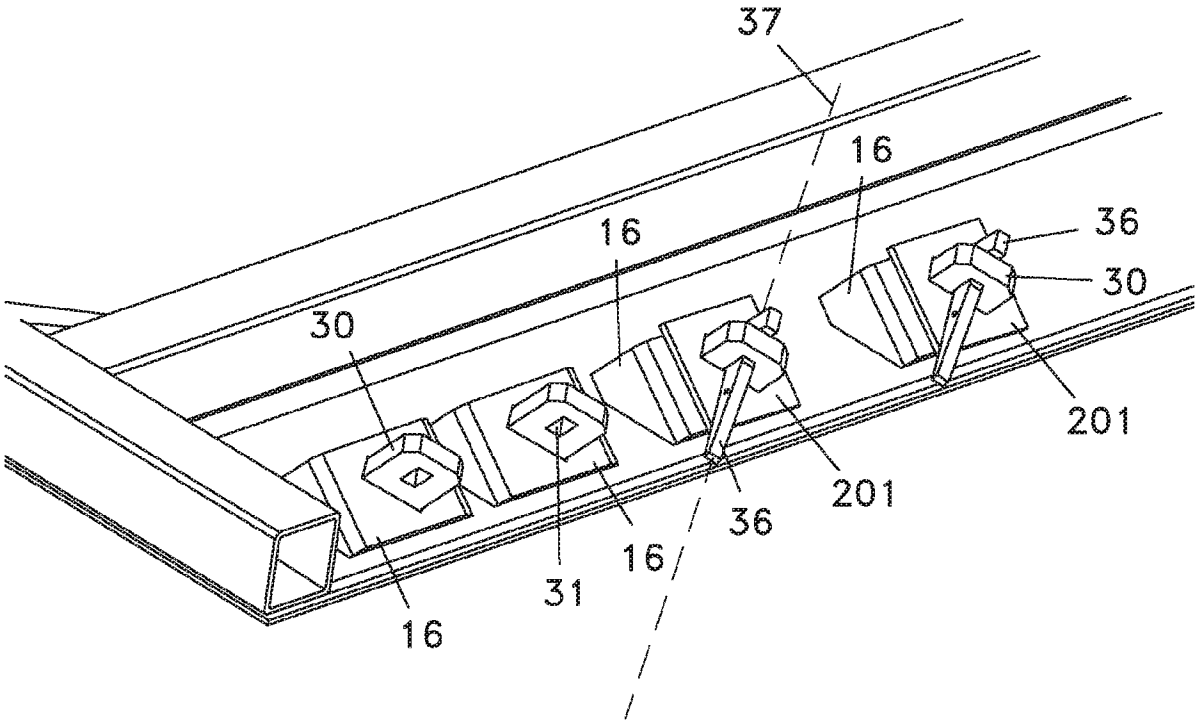
FIG. 13 shows a perspective view of a protrusion body established in a retreating flange and secured with a pin above a washer 201 (for two retreating flanges), and the associated panel, in at least one embodiment of the inventive technology (note that the advancing flange that is established between the washer and the outer face of the retreating flange in at least one embodiment of the inventive technology is not shown in this figure, for clarity reasons).
Figure 14A:
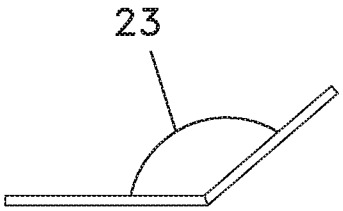
FIG. 14A shows a view from above an advancing flange (which would be substantially vertical in a constructed containment apparatus), including the attached component that facilitates its attachment to the panel body, as appears in at least one embodiment of the inventive technology.
Figure 14B:
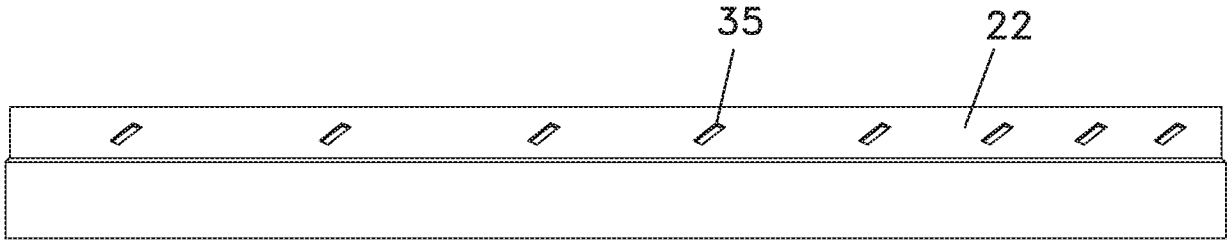
FIG. 14B shows a side view of an advancing flange (which would be substantially vertical in a constructed containment apparatus), including the attached component that facilitates its attachment to the panel body, as appears in at least one embodiment of the inventive technology.
Figure 15:
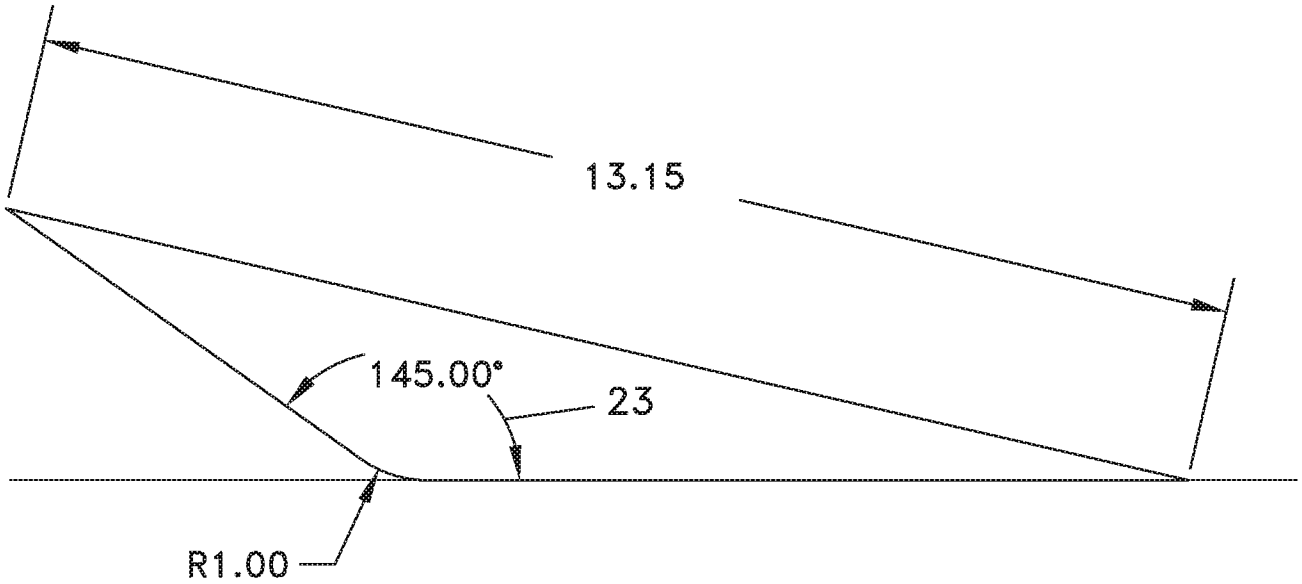
FIG. 15 shows possible dimensions of a view from above an advancing flange (which would be substantially vertical in a constructed containment apparatus), including the attached component that facilitates its attachment to the panel body, as appears in at least one embodiment of the inventive technology.
Figure 16:
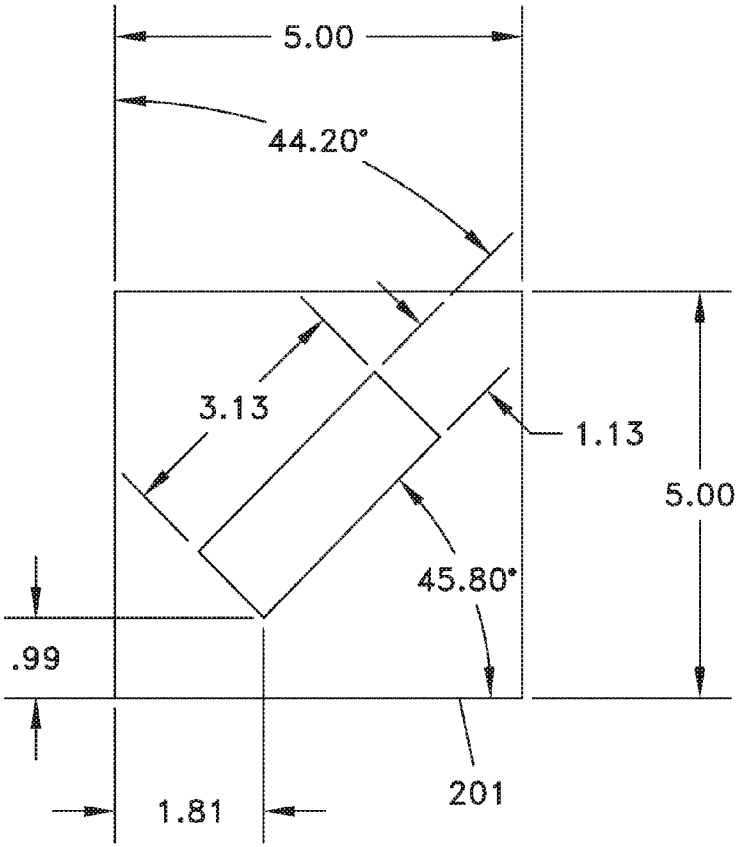
FIG. 16 shows a side view of a washer 201 (established in a substantially vertical plane in at least one embodiment of the constructed containment apparatus) that may be established between the pin and the advancing flange, as appears in at least one embodiment of the inventive technology.
Figure 17:
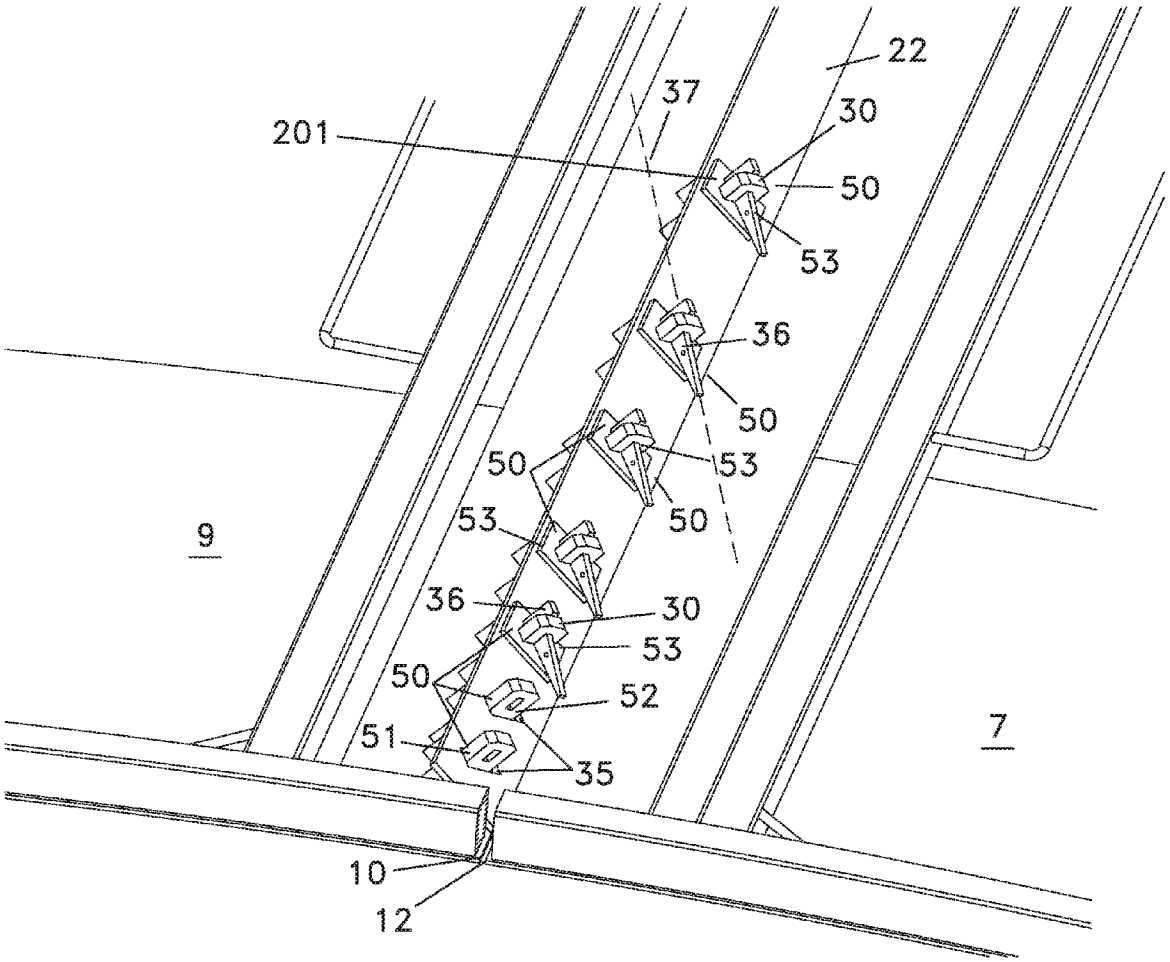
FIG. 17 shows a perspective view of proximate portions of two panels attached with attachment componentry as appears in at least one embodiment of the inventive technology (note that not all protrusions are shown with driven pins). This would be a pre-final installation condition and is shown for reasons relative to clarity. A final installation condition would, in certain embodiments, show pins driven through each first aperture shown, in addition to washers, potentially.

Note that, particularly with regard to the retreating flange (because, in a preferred design, protrusions extend from retreating flanges), the protrusions may be welded to the flanges, be molded or forged (or other type manufacture) so they are integrally connected with their associated flange, or, as shown in FIG. 9, e.g., be part of a protrusion body 301 that extends through an aperture 302 in the retreating flange itself. In such designs, the part of the body that is under the retreating flange may be expanded (flared) relative to the aperture that the body passes through (i.e., such that it can't be pulled through the aperture). While in some embodiments, the protrusion body may be somewhat movable in the flange's aperture (and may tighten up or become secure and immovable therein upon driving of pin 36), this is not a required feature. In particular embodiments, the protrusion body portion (whether flared or not) may be welded to the same vertical surface to which the retreating flange(s) may be welded.

The apparatus may further comprise attachment componentry for securing the first panel against the second panel at the sealing, first panel, second panel contact surface and for securing the first panel against the third panel at the sealing, first panel, third panel contact surface. The attachment componentry may comprise flange supported protrusions 30 at the second panel side of the first panel, where each of the flange supported protrusions have a first aperture 31, and a protrusion shape and protrusion size. The attachment componentry may further comprise second apertures 35 at the third panel side of the first panel for receiving flange supported protrusions of the third panel; the second apertures may be at least of the protrusion size (and certainly may be larger than the protrusion size). The first apertures of the first panel may be sized and positioned on the flange supported protrusions so as to receive a pin 36 when the flange supported protrusions of the first panel are established in second apertures of the second panel. Driving such a pin may create an interference-fit type pressurization of contact surfaces against one another (in addition to perhaps creating an increase in the tightness of other fittings, such as perhaps the perhaps the protrusion body in retreating flange fitting), resulting in a tight, virtually impenetrable seal therebetween. Such a tight seal makes difficult or even impossible vandalizing attempts to pierce liners (e.g., with a knife or pointed object) contained inside of the structure, thereby preventing leaking of contained fluid. Note that even where there is included fewer than all components necessary for attachment, it may be said that the apparatus comprises attachment componentry.

The flange supported protrusions may define driven pin axes 37 (along the length of the pins) in a vertical plane (which may or may not be the same plane for each pin). The vertical plane, e.g., may be parallel with a plane defined by the face of an associated retreating flange. At least one of the driven pin axes may be off-vertical (i.e., not straight up and down, although likely lying in a vertical plane). Further, as mentioned, the apparatus may further comprise such pins, for driving through the first apertures of the first panel when the flange supported protrusions of the first panel are established in the second apertures of the second panel. Outer edges 38 of at least one of the flange supported protrusions may define a stabilizing protrusion shape in a vertical plane (which may or may not coincide with a plane defined by the face(s) of the retreating flange(s), and/or which may or may not be the same as (or parallel with) the vertical plane that includes an associated driven pin axis). Such vertical plane is typically parallel with a plane that may be formed by the front face of the retreating flange (against which the advancing flange may be forced). Further, at least one of the second apertures may define a stabilizing aperture shape (rectangular, as but one example) that corresponds with the stabilizing protrusion shape (such that the protrusion shape can fit into the stabilizing aperture shape and, upon driving of an associated pin through associated first apertures 31, is forced into a position in the second aperture that effectively "locks" the protrusion into proper position). In other words, the protrusion shape may be considered stabilizing when considered relative to the shape of the second apertures that the protrusions fit in, and relative to the securing force applied by driven pins. Aperture shapes that have corners at the bottom, the top and on the two sides may, upon driving of the pins, "trap" and secure the protrusion substantially against one of those corners in a stable, seated manner. In at least one embodiment, driving of the pin forces the protrusion up against the upper corner of the second aperture so that it seats in that corner. However, other corners may, in other designs, provide the stabilizing, seat for the protrusion. Further, the second apertures may be located so as to stabilize the associated flange supported protrusion of the third panel having the stabilizing protrusion shape when the flange supported protrusions of the third panel are established in the second apertures of the first panel and the third panel is attached to the first panel (upon driving of pins).

In those preferred embodiments where the flange supported protrusions extend from the at least one retreating flange, the second apertures may be in (e.g., through) the at least one advancing flange. In other embodiments, the flange supported protrusions may extend from the at least one advancing flange and the second apertures may be in the at least one retreating flange.

In certain preferred embodiments, the attachment componentry may comprise flange supported protrusions at the third panel side of the first panel; each of the flange supported protrusions may have a first aperture and a protrusion shape and protrusion size. The attachment componentry may further comprise second apertures at the second panel side of the first panel for receiving flange supported protrusions of the second panel; the second apertures may be at least of the protrusion size. Other features of the attachment componentry used to connect panels may be as described as above. In certain other embodiments, the attachment componentry may comprise flange supported protrusions at the second panel side of the first panel; each of the flange supported protrusions may have a first aperture and a protrusion shape and protrusion size. The attachment componentry may further comprise second apertures at the third panel side of the first panel for receiving flange supported protrusions of the third panel; the second apertures may be at least of the protrusion size. Other features of the attachment componentry used to connect panels may be as described as above.

In certain embodiments, the flange supported protrusions may extend from the at least one retreating flange and the second apertures are in the at least one advancing flange. However, in other embodiments the flange supported protrusions may extend from the at least one advancing flange and the second apertures are in the at least one retreating flange.

In particular embodiments, and regardless of which panel is attached to which panel), the second apertures are larger than the protrusion size. This may facilitate construction (in that larger holes may make crane supported insertion of protrusions into second apertures easier) and facilitate a stable seating of the protrusions in the apertures during driving of the pins (in that protrusions may be moved to stable, obstructed positions). Such stable positioning may be achieved when the sealing contact surfaces of adjacent panels are tight against each other. Driving of the pins may create this tight sealing. Of course, such contact surfaces are those surfaces that actually, during apparatus operation, are against one another and create the interpanel seal.

The at least one retreating flange (on one side of a panel) may be one, or a plurality (i.e., more than one) of retreating flanges. The plurality of retreating flanges may comprise one retreating flange for each of the flange supported protrusions. Similarly, the at least one advancing flange may comprise only one advancing flange, in certain embodiments, but a plurality in others.

The first panel fluid containment component (which is the portion of the panel that the liner or the contained fluid may pressurize) may have a fluid containment component shape in a horizontal plane, such shape may be curved, arcuate, and/or straight (perhaps even in different sections).

In a related aspect of the inventive technology (see, e.g., FIGS. 18 and 19), the attachment componentry may comprise a plurality of sets 50 of attachment components that comprise a lowest set 51, a second lowest set 52 and remaining sets 53, and wherein a first vertical distance 54 between at least one 55 of said remaining sets and a second 59 of said plurality of sets that is adjacent and lower than said at least one of said remaining sets is greater than a second vertical distance 56 between said second of said plurality of sets and a third set 57 that is adjacent and lower than said second of said plurality of sets (of attachment components). The second vertical distance may be greater than the third vertical distance 61 between the third set and a fourth set 62 that is adjacent and lower than the third set. The first vertical distance divided by said second vertical distance is a first ratio, said second vertical distance divided by said third vertical distance is a second ratio, and said first ratio and said second ratio are greater than one and substantially equal. Note that this may be characteristic of a majority of the pairs of sets (where a pair is two sets, one directly above the other); indeed, in certain embodiments, placement of all sets (or fewer than all) may be arranged in accordance with this pattern. Such arrangement may conserve costs associated with attachment componentry by using and placing such components only as necessary to counter the gravity-induced pressure response against the panels from the contained fluid. Of course, such pressure increases linearly with fluid depth.

Figure 1A:
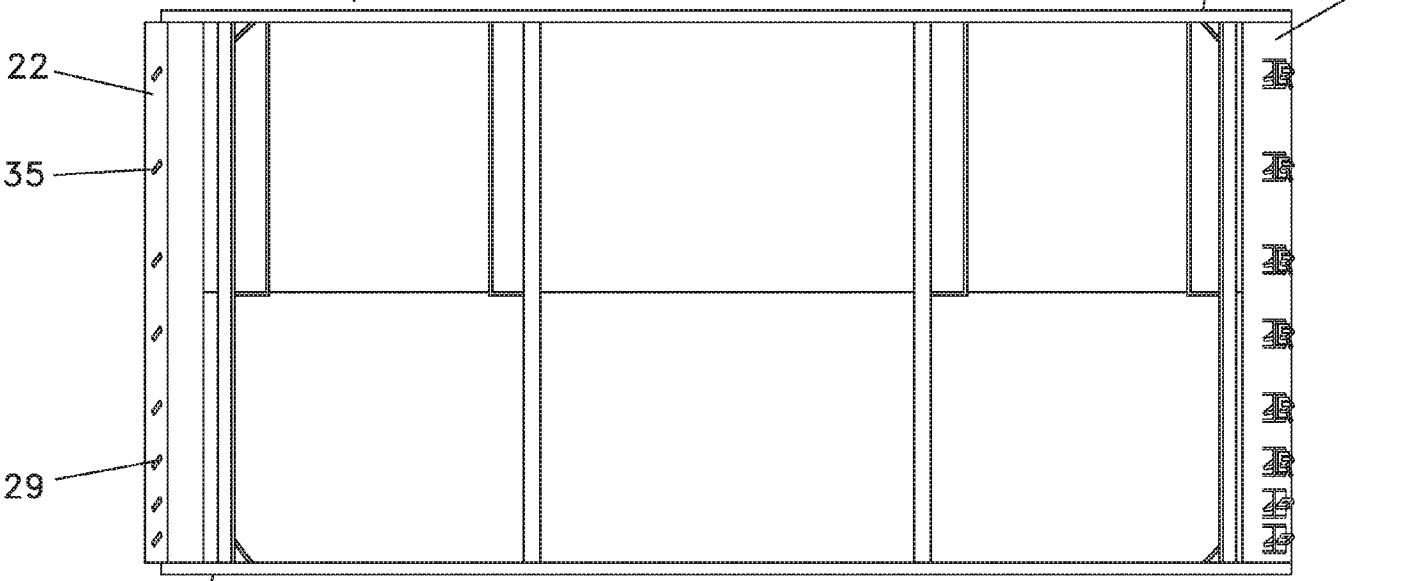
FIG. 1A shows a view from above of at least one embodiment of an inventive panel.
Figure 2:
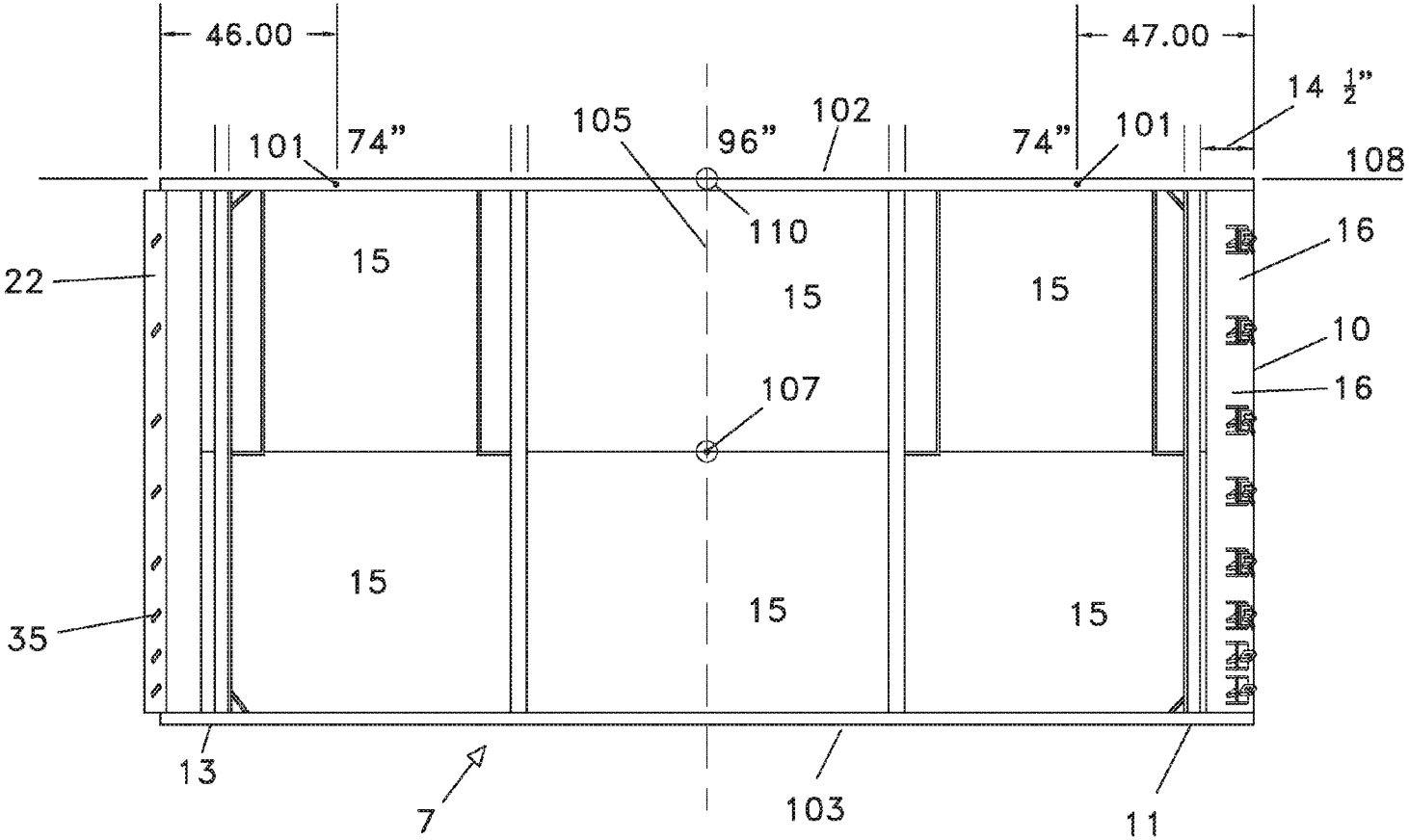
FIG. 2 shows a side, external view of at least one embodiment of an inventive panel.

In certain embodiments, the plurality of panels (used to make a single tank) may comprise at least 6 panels; in others, there may be at least 12 panels or at least 16 panels (in at least one embodiment, there are precisely 16 panels). Regardless, in particular possible designs, the second panel may be attached clockwise (when viewed from above) of the first panel and the third panel is attached counter-clockwise of the first panel, while in other designs the second panel may be established counter-clockwise of the first panel and the third panel is established clockwise of the first panel (see, e.g, FIG. 1B). Note that, as should be understood, in FIG. 1A, for example, the contained fluid, when such panel is established as part of a fluid containment apparatus, the contained fluid would be on the side defining a convex space (i.e., above the panel in FIG. 1A).

At least one aspect of the inventive technology may be described as a panel configured for side-to-side attachment with other panels to form an annular fluid containment structure as shown in, e.g., FIG. 26 (whether each panel has curved sides when viewed from above or not), wherein, during operation of the annular fluid containment structure, the panel is a first panel that is established between a second panel and a third panel, the first panel contacts the second panel at a sealing, first panel, second panel contact surface on a second panel side of the first panel, and the first panel contacts the third panel at a sealing, first panel, third panel contact surface on a third panel side of the first panel. The first panel may comprise a first panel fluid containment component substantially between the sealing, first panel, third panel contact surface and the sealing, first panel, second panel contact surface, with at least one retreating flange forming a part of the first panel and established at the second panel side thereof (indeed, in these embodiments, the location of the at least one retreating flange may define which side of the first panel is the second panel side). The at least one retreating flange may define, in a horizontal plane, a first angle relative to a first panel side of a tangent line passing through a fluid proximate portion of the sealing, first panel, second panel contact surface, wherein the first angle is an acute angle of x degrees. The first panel may further comprise at least one advancing flange forming a part of the first panel and established at the third panel side thereof, the at least one advancing flange defining, in a horizontal plane, a second angle relative to a first panel side of a tangent line passing through a fluid proximate portion of the sealing, first panel, third panel contact surface. That second angle may be an obtuse angle of at most 180 degrees minus the aforementioned x degrees. The apparatus may further comprise attachment componentry for enabling attachment of the first panel against the second panel at the sealing, first panel, second panel contact surface and attachment of the first panel against the third panel at the sealing, first panel, third panel contact surface. Attachment componentry may be as described elsewhere in this disclosure.

It is of note that the panel configured for side-to-side attachment with other panels to form an annular fluid containment structure may comprise a panel configured for side-to-side attachment with at least five, at least 11, or at least 15 other panels to form an annular fluid containment structure. In this and other embodiments, the first panel fluid containment component may have a fluid containment component shape in a horizontal plane (after construction, or during operation, of the containment structure); the fluid containment component shape is selected from the group of shapes consisting of: curved, arcuate, and straight, curved and straight, straight in sections (with angled bends therebetween), etc.)

Figure 27A:
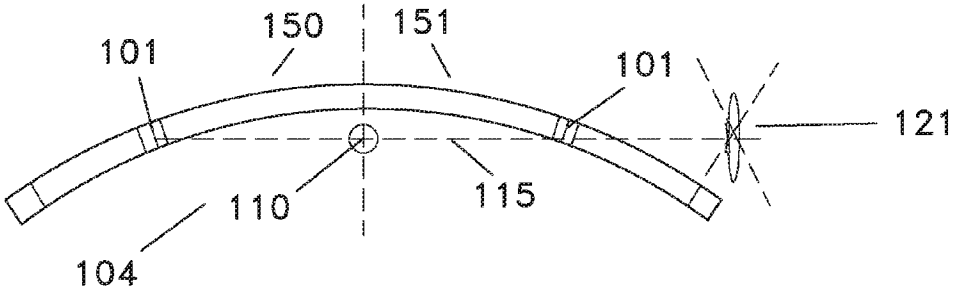
FIG. 27A shows a top view of at least one embodiment of an inventive panel; this figure in particular shows a panel with right and left halves of approximately equal weight, crane hook attachment components situated along the top edge so that a line between them passes through a top edge center of mass (as defined herein) and, thus, during suspension at the crane hook attachment components, rotation of the panel about a horizontal axis that is normal to a radial line defined by the shown shape of the panel) is precluded (see 121). Note that a radial line is said to exist even where a panel is not of circular arc (e.g, in the case of a polygon formed by several panels). The dashed X in FIGS. 27A, 27B and 27C indicates prevention of rotation. Because this figures shows a panel with right and left halves of approximately equal weight, symmetric location of crane hook attachment components will not result in any rotation of the suspended panel about a substantially radial axis.
Figure 27B:
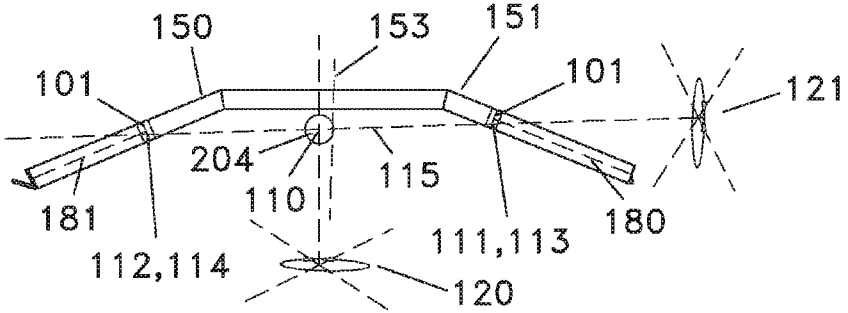
FIG. 27B shows a top view of at least one embodiment of an inventive panel; this figure in particular shows a panel with right and left halves of different weight. Crane hook attachment components are situated along the top edge so that a line between them passes through a top edge center of mass (as defined herein) and, thus, during suspension at the crane hook attachment components, rotation of the panel about a horizontal axis that is normal to a radial line defined by the shown shape of the panel) is precluded (see 121). Further, their asymmetric placement (i.e., where distance 181 is less than distance 180) prevents rotation (see 120) during suspension by a crane about a radial axis, that would occur otherwise because of the panel's aforementioned asymmetric weight distribution.
Figure 27C:
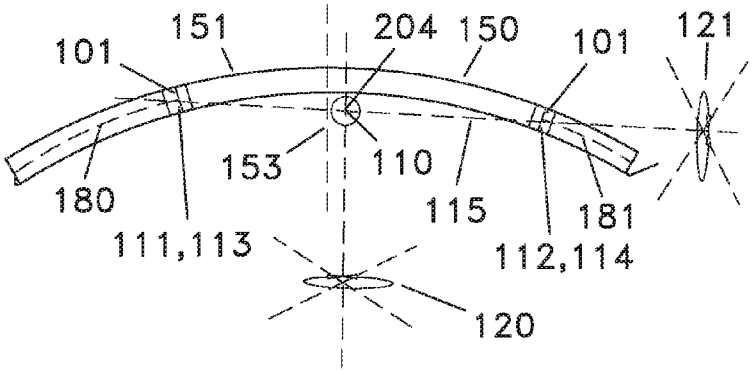
FIG. 27C shows a top view of at least one embodiment of an inventive panel; this figure in particular shows a panel with right and left halves of different weight. Crane hook attachment components are situated along the top edge so that a line between them passes through a top edge center of mass (as defined herein) and, thus, during suspension at the crane hook attachment components, rotation of the panel about a horizontal axis that is normal to a radial line defined by the shown shape of the panel) is precluded (see 121). Further, their asymmetric placement (i.e., where distance 181 is less than distance 180) prevents rotation (see 120) during suspension by a crane about a radial axis, that would occur otherwise because of the panel's aforementioned asymmetric weight distribution.
Figure 28:
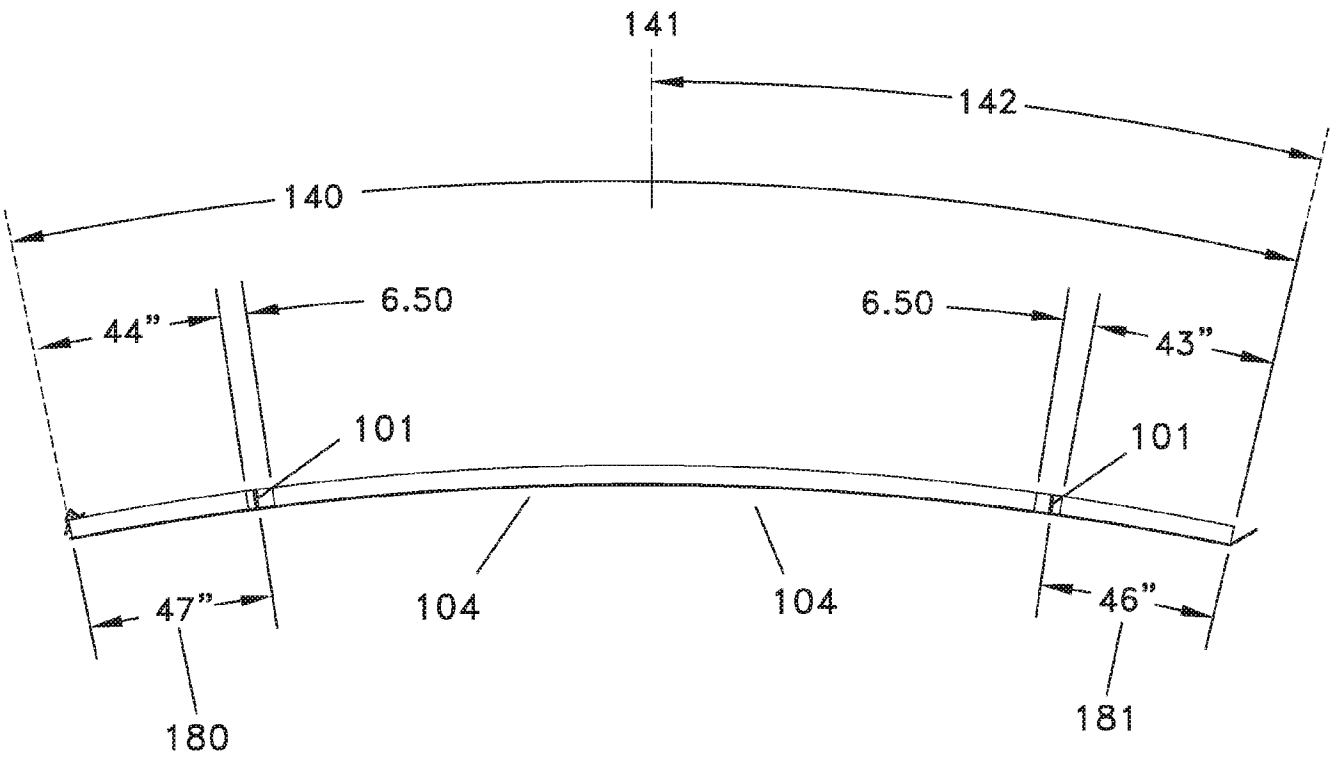
FIG. 28 shows a top view of at least one embodiment of an inventive panel; this figure in particular shows a panel with right and left halves of different weight. Crane hook attachment components are as described in FIG. 27C, with certain possible dimensions shown.

As shown in exemplary FIGS. 27 and 28, certain embodiments of the inventive technology focusing more on locations of crane hook attachment component 101 (e.g., hookable horizontal bars) locations may be described as a panel configured for side-to-side attachment with other panels to form an annular fluid containment structure, wherein during operation of the annular fluid containment structure, the panel is a first panel that is established between a second panel and a third panel, the first panel contacts the second panel at a sealing, first panel, second panel contact surface on a second panel side of the first panel, and contacts the third panel at a sealing, first panel, third panel contact surface on a third panel side of the first panel. As in other inventive aspects, the first panel may comprise a contained fluid containment component having a top edge 102 and a bottom edge 103, and established substantially between the sealing, first panel, second panel contact surface and the sealing, first panel, third panel contact surface. The contained fluid component may have a contained fluid side that has a concave shape that defines a convex space. This may be the case with a curved panel (when viewed from above), or a panel that has (when viewed from above) a plurality of straight sections that define a convex space 104. The first panel may have a mass center of gravity 107 located within the convex space, and a vertical line 105 through the mass center of gravity may intersect a horizontal plane 108 passing through the top edge of the first panel at a top edge mass center 110. It is of note that this mass center does not necessarily coincide with mass centers of other horizontal planes passing through the panel (as at different heights, there may be horizontal, structural tubing. A first crane hook attachment component 113 may be established at a first location 111 substantially on the top edge, and a second crane hook attachment component 112 may be established substantially at a second location 114 substantially on the top edge. Further, a straight line 115, in the horizontal plane passing through the top edge, from the first crane hook attachment component to the second crane hook attachment component may pass substantially through the top edge mass center. Location of the crane hook attachment component sites in accordance with this constraint will preferably preclude gravity-induced mis-orientation (particularly of a lower part of the tank in a radial direction towards or away from a vertical line passing through the center of the constructed tank) during suspension of the panel by crane cables (connected to the crane at one point), connected at the aforementioned crane hook attachment component sites (see 121). Such misorientation results in an off-vertical position of the suspended panel and is seen where the lower edge of the panel (during suspension by a crane) is not directly above the upper edge; this may result in misalignment of the protrusions with their associated apertures, and a resulting cumbersome and time consuming difficulty during construction. Precluding such misorientation increases the efficiency of construction. Of course, any panel may include such strategic placement of crane hook attachment components. Note that the very presence of crane hook attachment components prefabricated as part of the panel (on its top edge, e.g.), may be inventive in and of itself.

In particular embodiments, the crane hook attachment components are located (during panel manufacture and design, e.g.,) so that the top edge mass center substantially bisects the line 115 (i.e., the line in the horizontal plane passing through the top edge, from the first crane hook attachment component to the second crane hook attachment component) at a bisection location 204. This may prevent a different type of mis-orientation, such as rotation about an axis that is radial relative to the constructed tank, of the panel during suspension of the panel by a crane (see 120). Precluding such misorientation also increases the efficiency of construction because it precludes misalignment of attachment components of adjacent panels that are to be connected with one another.

Note that in certain embodiments, one geometrically measured half (when suspended and viewed from above) of the panel may be heavier than the other half (see, e.g., FIGS. 27B, 27C and 28). More particularly, the first panel may have a top edge parametrical distance 140 from the sealing, first panel, second panel contact surface to the sealing, first panel, third panel contact surface, and a halfway location 141 that is halfway 142 along the top edge parametrical distance. The first panel may have a third panel proximate half 150 on one side of a vertical plane 153 passing through the halfway point and a second panel proximate half 151 on the other side of the vertical plane. The third panel proximate half may be that side that is heavier than the second panel proximate half (in certain embodiments, this may be reversed). The first crane hook attachment component may be established a first distance 180 from a top end of a contained fluid proximate portion of the sealing, first panel, second panel contact surface and the second crane hook attachment component may be established at a second distance 181 from a top end of a contained fluid proximate portion of the sealing, first panel, third panel contact surface. In particular embodiments where one half is heavier than the other half, where the aforementioned line between the crane hook attachment components is bisected by the top edge mass center, the first distance and the second distance may be different. This may prevent the aforementioned rotation (120) of the panel about a radial axis during suspension of the panel by a crane at the strategically placed crane hook attachment component site. In embodiments where one half (e.g., a third panel proximate half) of a suspended panel is heavier than the other half), the second distance may be less than the first distance (e.g., approximately one inch less, as but one of many examples). The second distance may be approximately one per-cent less than the first distance, as but one of many per-centage type examples. More generally, and viewed another way, note that the first panel may be said to have has a top edge parametrical distance from said sealing, first panel, second panel contact surface to said sealing, first panel, third panel contact surface, and a halfway location that is halfway along said top edge parametrical distance. In certain embodiments where one half (e.g. a right half) is heavier than the other half, the bisection location does not lie on a radial line passing through the halfway location. Of course, any panel may include such strategic placement of crane hook attachment components.

Figure 18:
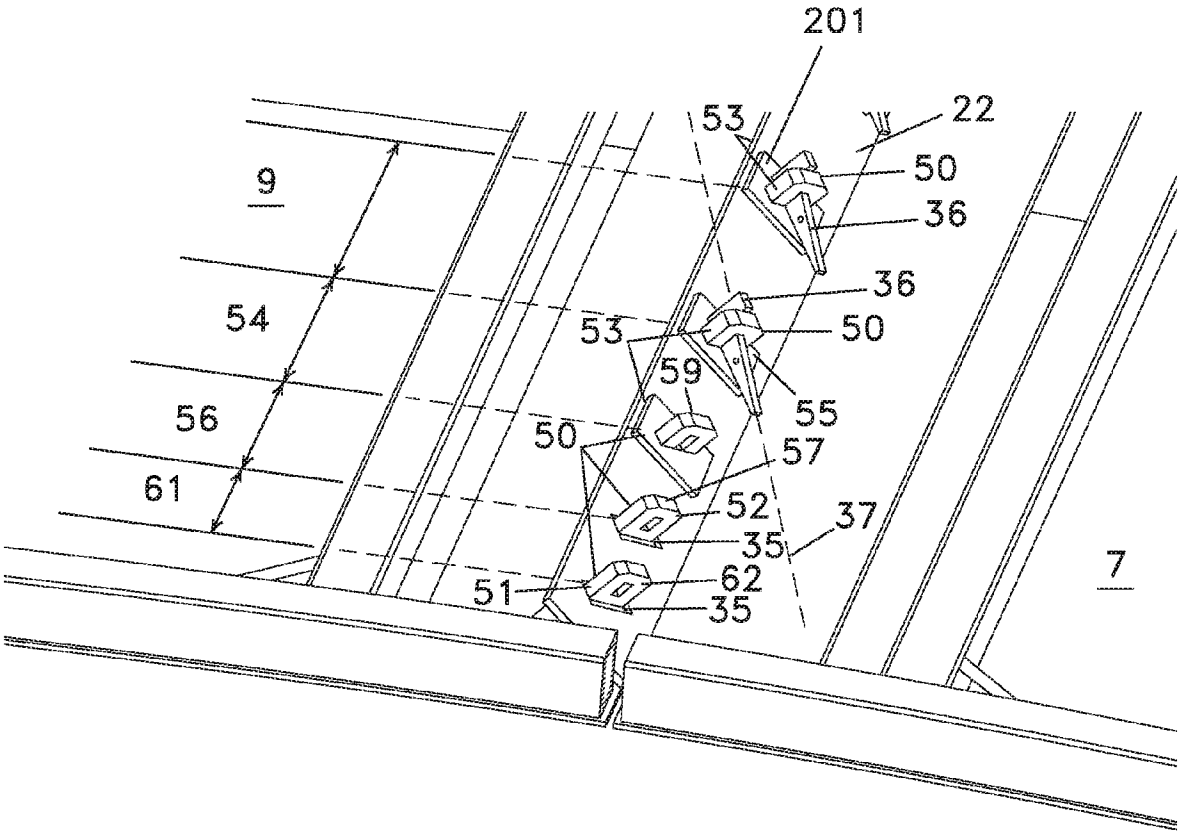
FIG. 18 shows a perspective view of proximate portions of two panels attached with attachment componentry as appears in at least one embodiment of the inventive technology (note that not all protrusions are shown with driven pins).
Figure 19:
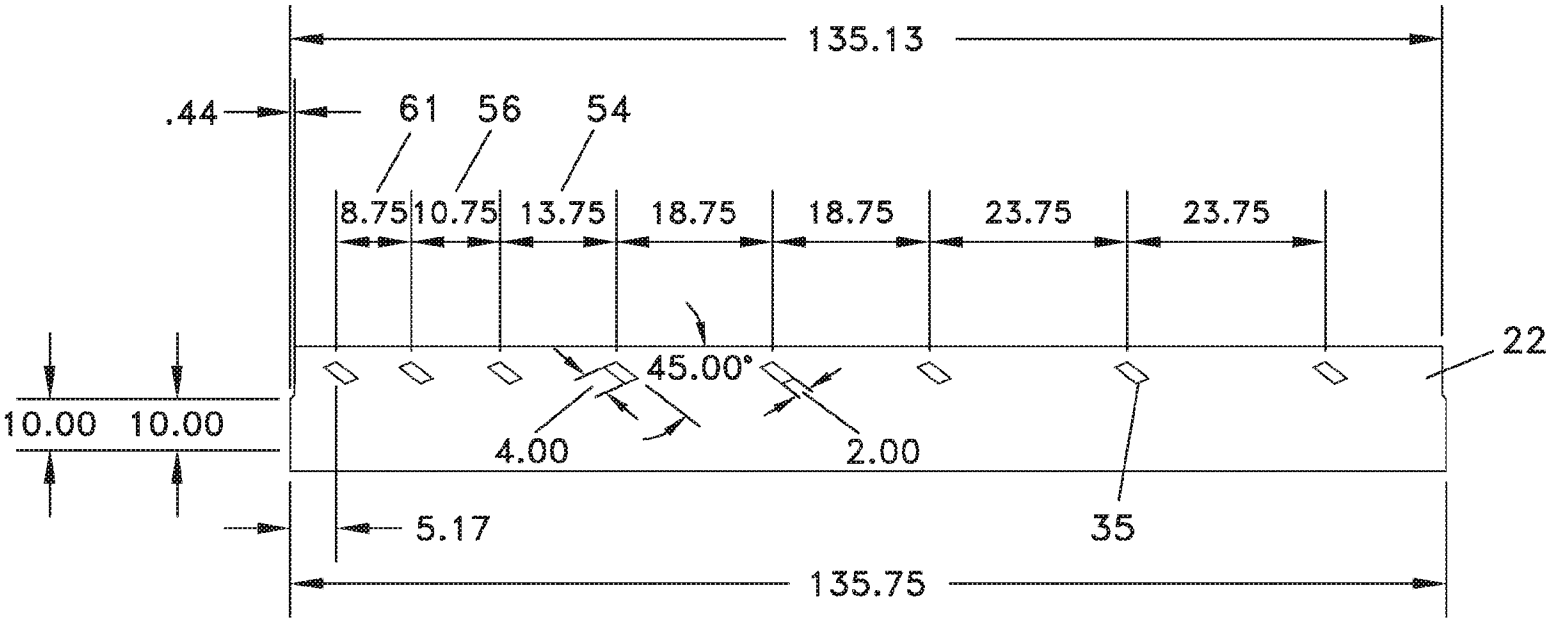
FIG. 19 shows a side view of an advancing flange (which would be substantially vertical in a constructed containment apparatus), including the attached component that facilitates its attachment to the panel body, with possible dimensions, as appears in at least one embodiment of the inventive technology.
Figure 20:
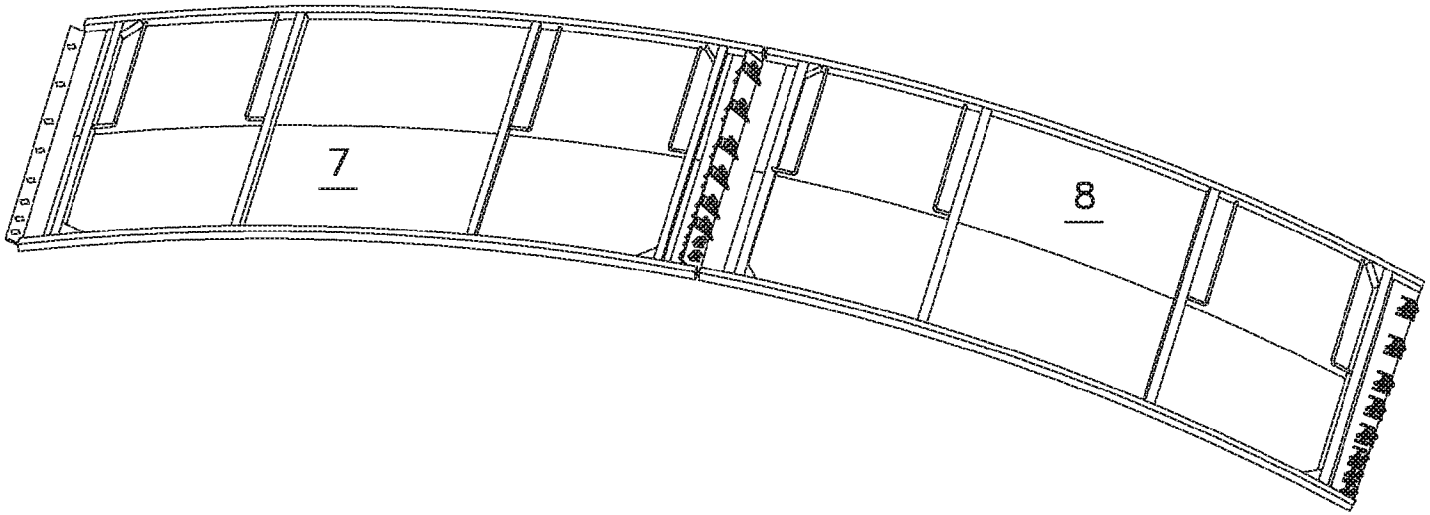
FIG. 20 shows a perspective view of two connected panels of a fluid containment apparatus as seen in at least one embodiment of the inventive technology.
Figure 21A:
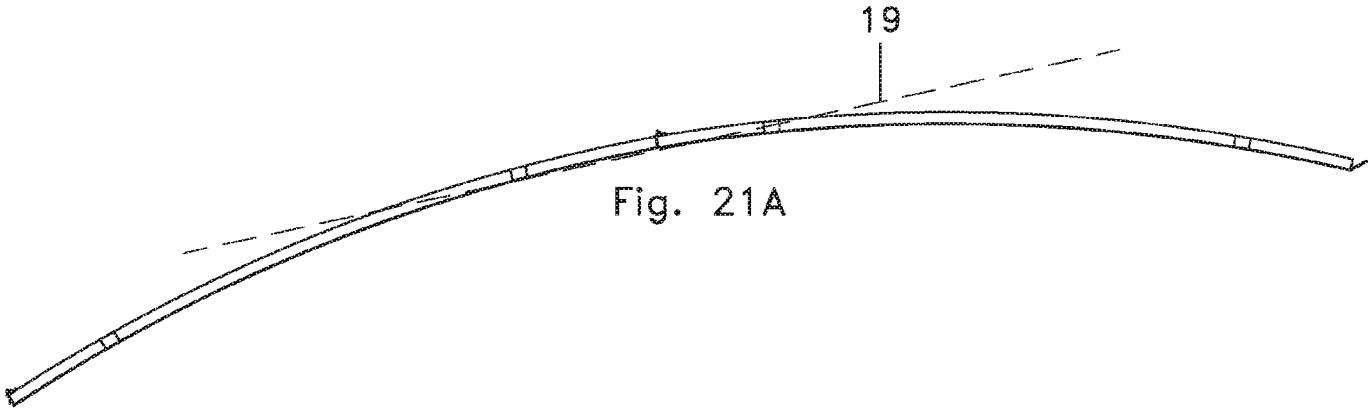
FIG. 21A shows a top view from above of two connected panels of a fluid containment apparatus as seen in at least one embodiment of the inventive technology.
Figure 21B:
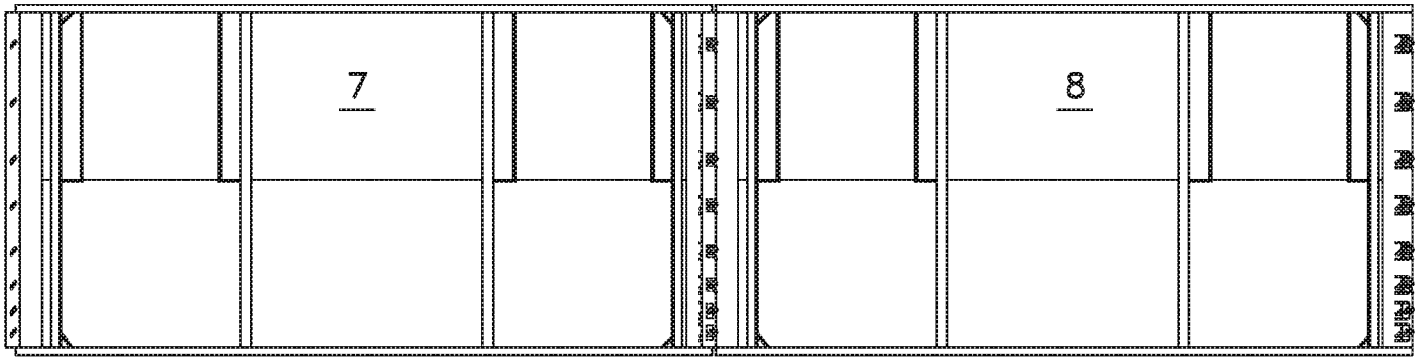
FIG. 21B shows a side view from above of two connected panels of a fluid containment apparatus as seen in at least one embodiment of the inventive technology.
Figure 22B:
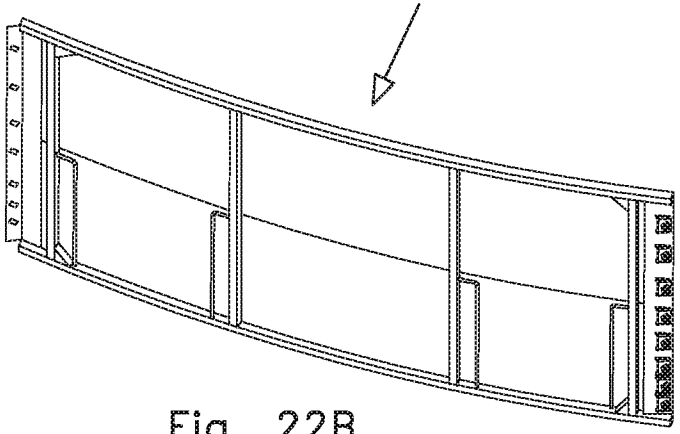
FIG. 22B shows a perspective view of a panel as found in at least one embodiment of the inventive technology.
Figure 22A:
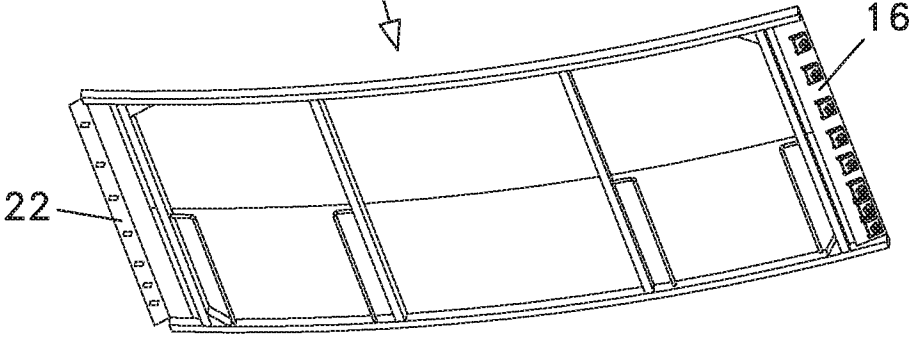
FIG. 22A shows a perspective view of a panel as found in at least one embodiment of the inventive technology.
Figure 22C:
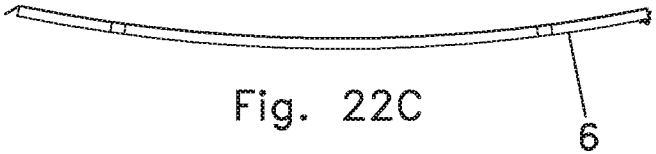
FIG. 22C shows a top view of a panel as seen in FIGS. 22A and 22B, as found in at least one embodiment of the inventive technology.
Figure 23A:
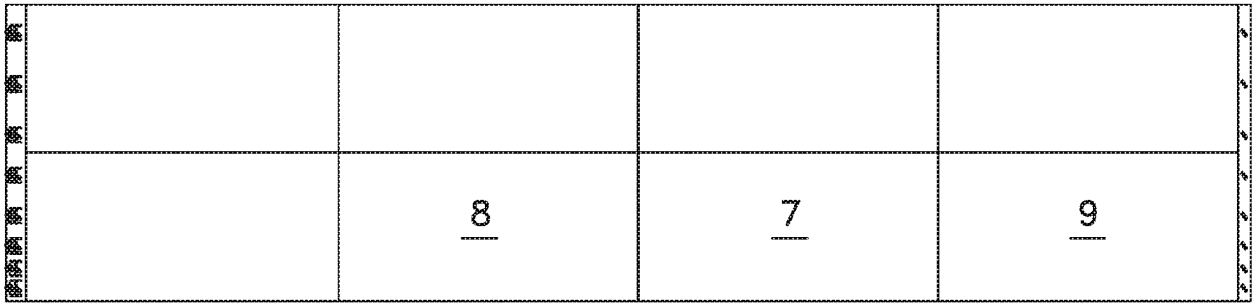
FIG. 23A shows a side view of four connected panels of a fluid containment apparatus as seen in at least one embodiment of the inventive technology.
Figure 23B:
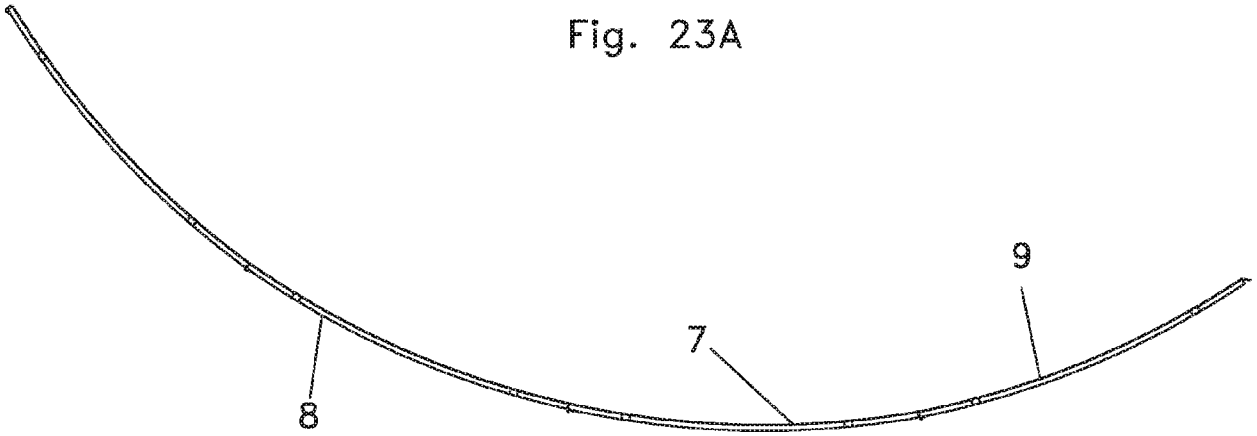
FIG. 23B shows a top view of four connected panels of a fluid containment apparatus as seen in at least one embodiment of the inventive technology.
Figure 24:
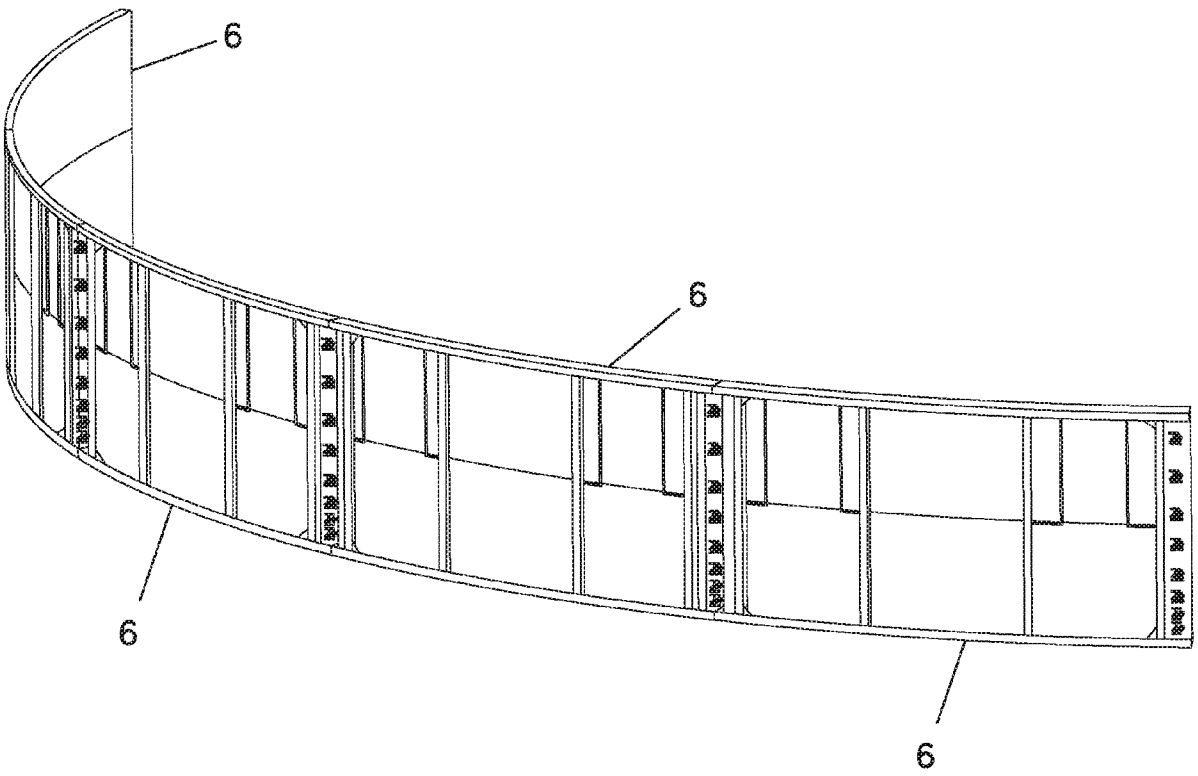
FIG. 24 shows a perspective view of four connected panels of an annular fluid containment structure of at least one embodiment of the inventive technology.
Figure 25:
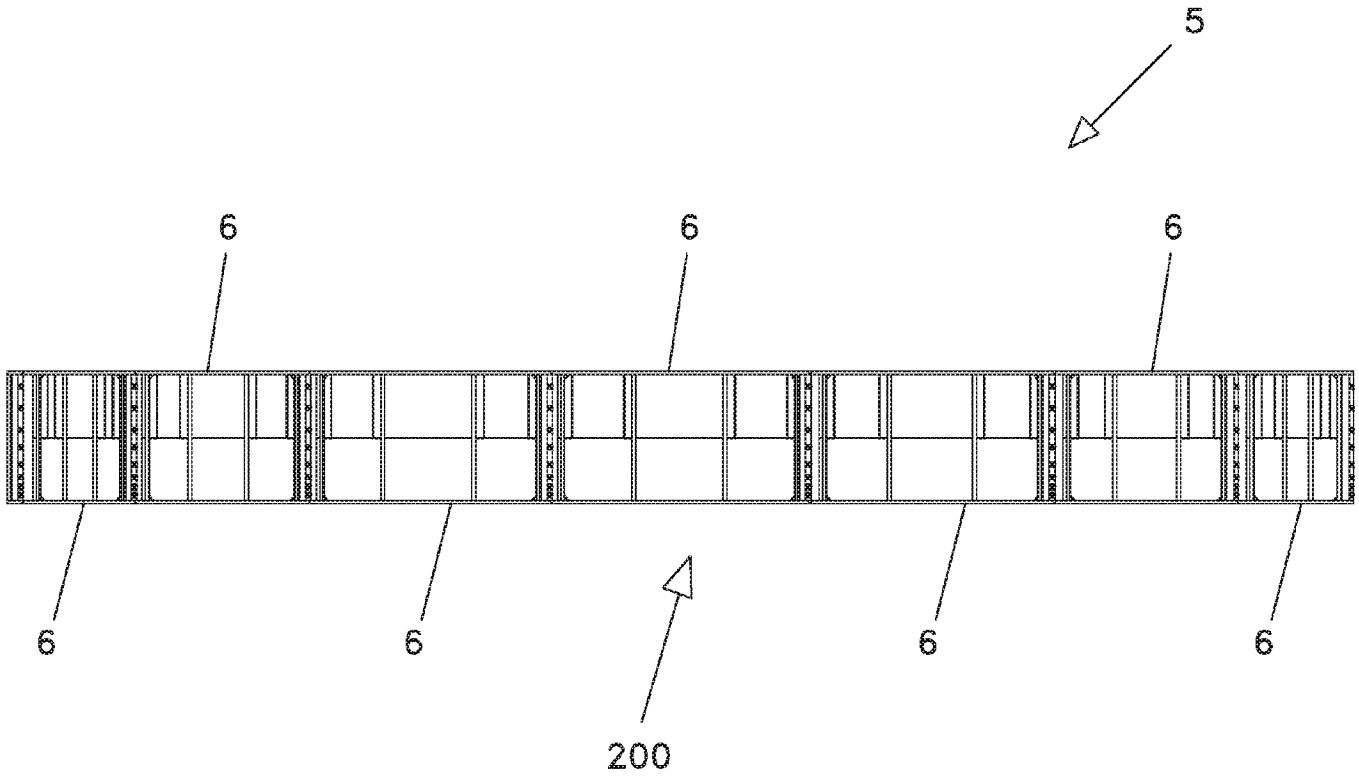
FIG. 25 shows a side view of four connected panels of an annular fluid containment structure of at least one embodiment of the inventive technology.

Another independent aspect of the inventive technology disclosed herein relates to angled pin axes (see, e.g., FIG. 18). More particularly, this aspect may be described as a panel configured for side-to-side attachment with other panels to form an annular fluid containment structure, wherein: during operation of the annular fluid containment structure, the panel is a first panel that is established between a second panel and a third panel, the first panel contacts the second panel at a sealing, first panel, second panel contact surface on a second panel side of the first panel, and contacts the third panel at a sealing, first panel, third panel contact surface on a third panel side of the first panel. The first panel may comprise: a first panel fluid containment component substantially between the sealing, first panel, third panel contact surface and the sealing, first panel, second panel contact surface; at least one second panel proximate flange forming a part of the first panel and established at the second panel side thereof; and at least one third panel proximate flange forming a part of the first panel and established at the third panel side thereof. The first panel may further comprise attachment componentry for enabling attachment of the first panel against the second panel at the sealing, first panel, second panel contact surface and attachment of the first panel against the third panel at the sealing, first panel, third panel contact surface. The attachment componentry may comprise flange supported protrusions at the second panel side of the first panel; each of the flange supported protrusions may have a first aperture and a protrusion shape and protrusion size. The attachment componentry may comprise second apertures at the third panel side of the first panel for receiving flange supported protrusions of the third panel, the second apertures being at least of the protrusion size. The first apertures of the first panel may be sized and positioned on the flange supported protrusions so as to receive a pin when the flange supported protrusions of the first panel are established in second apertures of the second panel. The flange supported protrusions may define driven pin axes in a vertical plane, and at least one (perhaps even all of the pin axes) of the driven pin axes may be off-vertical. Orientation of the flange supported protrusions in such fashion may facilitate driving (e.g., with a hammer or sledge) of the pins, as a blow from directly above (which may be difficulty because attachment componentry directly above would likely obstruct such a blow) may not be required; a blow that is above and from the side—as allowed by this inventive aspect—may be sufficient and may avoid any obstruction attachment componentry directly above might otherwise present. It is of further note that the at least one second panel proximate flange may comprise at least one retreating flange, and the at least one third panel proximate flange may comprise at least one advancing flange. Such flanges may be as described elsewhere in this disclosure. Of course, the attachment componentry may further comprise pins for driving through the first apertures of the first panel when the flange supported protrusions of the first panel are established in the second apertures of the second panel.

Figures 29A, 29B, 29C:
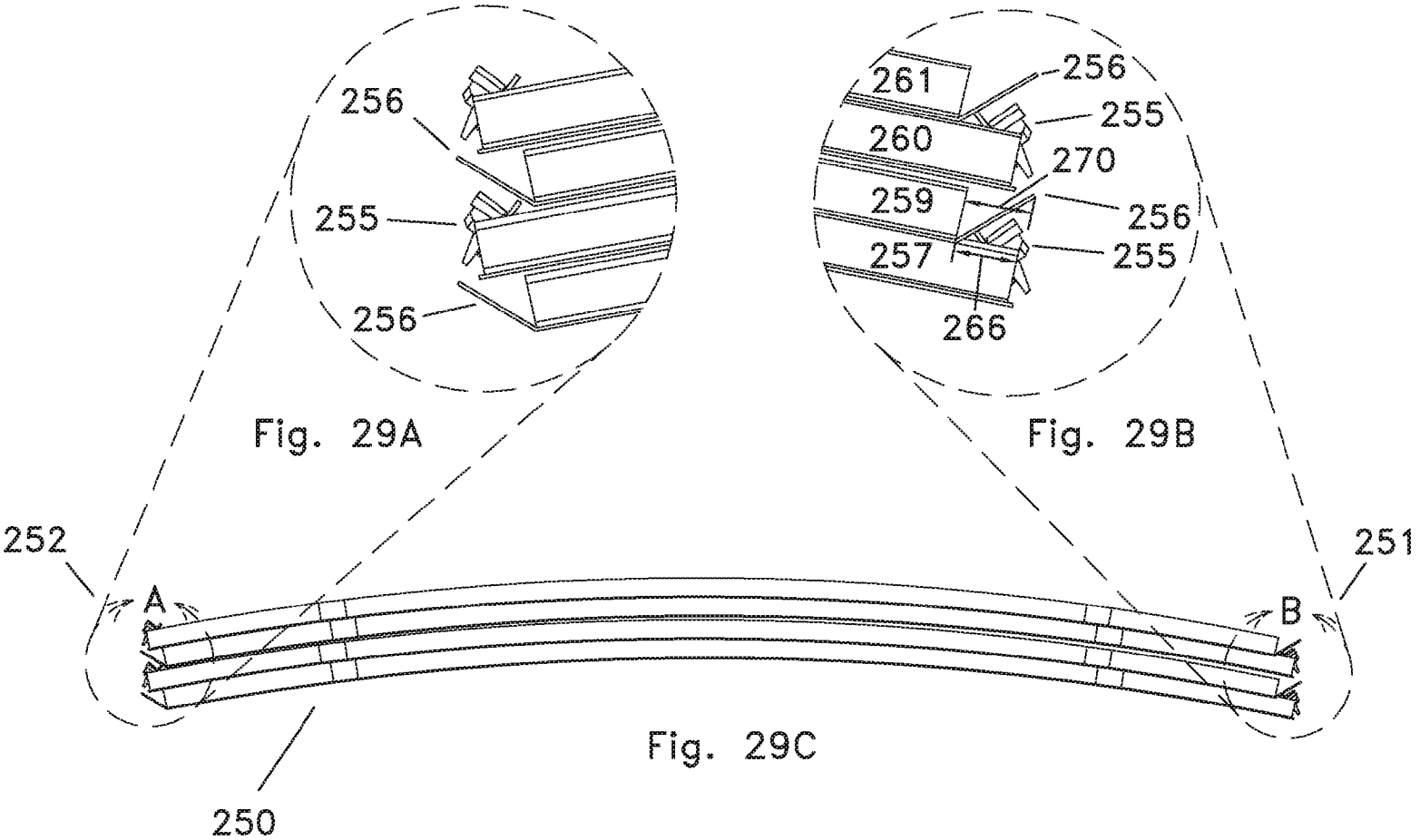
FIG. 29A shows a close-up of a front view of the left side of stacked panels in accordance with at least one embodiment of the inventive technology.
FIG. 29B shows a close-up of a front view of the right side of stacked panels in accordance with at least one embodiment of the inventive technology.
FIG. 29C shows a front view of the left side of stacked panels in accordance with at least one embodiment of the inventive technology.

Yet another independent aspect of the inventive technology, shown in exemplary fashion in FIGS. 29A, 29B and 29C, may relate to a stable panel stacking system and may be described as a stable, stacked plurality of panels 250 (for transport and/or storage) that are stacked such that the fluid proximate side of all panels are in only one vertical direction (i.e., either all facing down (preferred) or all facing up), and such that, on any given "attachment componentry side" (251 or 252) of the stack (which are the sides that the attachment componentry is on, and are considered right or left from the perspective of a person standing on a side of the stack that is proximate the sides of the panels that are top or bottom when panels are installed), different corresponding parts of attachment componentry present in alternating fashion, from lower to higher on the stack (e.g., protrusions 255 of retreating flange(s) of one panel 257 immediately below second apertures of an advancing flange(s) 256 of an adjacent panel 259 that is immediately above, which is below protrusions 255 of retreating flange(s) of an adjacent panel immediately above it 260, which is below second apertures of an advancing flange(s) of an adjacent panel 261 that is immediately above it, etc.). Panels with an advancing flange on a given side (right or left) can be positioned, during stacking, slightly away (offset) from that given side but not so far that any excessive contact between that advancing flange and a panel thereabove occurs (where the advancing flange extends high enough (in stacked configuration) to make such contact). Indeed, the offset distance 266 may be less than that distance that would cause panel damaging contact between said advancing flange and a panel directly thereabove, but large enough to position said advancing flange over protrusion attachment componentry of a panel directly therebelow, without causing damaging contact with said protrusion attachment componentry. Contact may be excessive (and cause damage) where stacking, whether for short or longer periods of time, causes damage such as plastic deformation of any panel component (e.g., permanent bending of advancing flanges). For example, if considering the right side of a stack, a panel with an advancing flange on that side would be moved slightly to the left (e.g., revolved and rotated about a center defined by the panel, as the moon about the earth, or tracing an arc of a circle defined by the panel's shape). As such, "to the left" may indicate counterclockwise. The extent of this offset distance may be less than the parametrical width 270 of an advancing flange but enough to allow for room for the retreating flange and the protrusion therefrom below it. When stacked in such a manner, the retreating flanges and their protrusions (on that given side) of a stacked panel are situated immediately below the advancing flange of the offset panel stacked directly above, without contact between the retreating flanges and their protrusions with the panel above (including not with the advancing flange of the panel above), and without contact with the panel (including the panels attachment componentry) below. In those embodiments where there is contact, such contact does not cause damage such as permanent bending. Such non-interference and/or absence of any deformation or damage causing contact may result in damage free stacking, stable (e.g., non-rocking) stacking, and/or result in a significant amount of contact surface between adjacently stacked panels. Such may further enhance the stability of stacked panels during shipping or storage. Of course, a panel stacking method corollary to this description is also part of the inventive technology.

Panels in conformity with the description immediately above should stack in stable, shape maintaining fashion. In particular, when the panels are stacked, the flanges of any one of the panel do not contact an adjacently stacked panel (including the flanges thereof) in a manner that causes either stacked panel instability (e.g., rocking back and forth) or plastic deformation of any of the stacked panels or their attachment componentry (over an extended period of time). Further, in certain embodiments, when the panels are stacked, the flanges of any one of the panel do not contact an adjacently stacked panel at all. Attachment componentry and flanges may be as described elsewhere in this disclosure.

As can be easily understood from the foregoing, the basic concepts of the present invention may be embodied in a variety of ways. It involves both multi-panel-type fluid containment techniques as well as devices to accomplish the appropriate fluid containment. In this application, the containment techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "pin" should be understood to encompass disclosure of the act of "pinning"—whether explicitly discussed or not—and, conversely, were there effectively disclosure of the act of "pinning", such a disclosure should be understood to encompass disclosure of a "pin" and even a "means for pinning" Such changes and alternative terms are to be understood to be explicitly included in the description. Further, each such means (whether explicitly so described or not) should be understood as encompassing all elements that can perform the given function, and all descriptions of elements that perform a described function should be understood as a non-limiting example of means for performing that function.

Any patents, publications, or other references mentioned in this application for patent are hereby incorporated by reference. Any priority case(s) claimed by this application is hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in any information disclosure statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the fluid containment and/or panel attachment devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) an apparatus for performing the methods described herein comprising means for performing the steps, xii) the various combinations and permutations of each of the elements disclosed, xiii) each potentially dependent claim or concept as a dependency on each and every one of the independent claims or concepts presented, and xiv) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in Hakim v. Cannon Avent Group, PLC, 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. The use of the phrase, "or any other claim" is used to provide support for any claim to be dependent on any other claim, such as another dependent claim, another independent claim, a previously listed claim, a subsequently listed claim, and the like. As one clarifying example, if a claim were dependent "on claim 20 or any other claim" or the like, it could be re-drafted as dependent on claim 1, claim 15, or even claim 25 (if such were to exist) if desired and still fall with the disclosure. It should be understood that this phrase also provides support for any combination of elements in the claims and even incorporates any desired proper antecedent basis for certain claim combinations such as with combinations of method, apparatus, process, and the like claims.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon. Note that the inventive technology is intended to also to cover a system substantially as herein described with reference to any one or more of the Figures and Description.

What is claimed is:

1. A fluid containment apparatus comprising a plurality of panels for side-to-side attachment, said apparatus, during operation thereof, comprising:

a first panel, a second panel and a third panel, wherein said first panel is established between said second panel and said third panel, contacts said second panel at a first sealing contact surface on a second panel side of said first panel, and contacts said third panel at a second sealing contact surface on a third panel side of said first panel, said first panel comprising:

a first panel fluid containment component substantially between said first sealing contact surface and said second sealing contact surface, at least one retreating flange forming a part of said first panel and established at said second panel side thereof, wherein a fluid proximate part of said at least one retreating flange defines, in a horizontal plane, a line that forms a first angle with a first panel side of a line that is tangent to said first and second panels and that passes through a fluid proximate portion of said first sealing contact surface, wherein said first angle is an acute angle of x degrees;

at least one advancing flange forming a part of said first panel and established at said third panel side thereof, wherein a fluid proximate part of said at least one advancing flange defines, in a horizontal plane, a line that forms a second angle with a first panel side of a line that is tangent to said first and third panels and that passes through a fluid proximate portion of said second sealing contact surface, wherein said second angle is an obtuse angle of at most 180 degrees minus said x degrees;

said apparatus further comprising attachment componentry for securing said first panel against said second panel at said first sealing contact surface and for securing said first panel against said third panel at said second sealing contact surface.

2. The fluid containment apparatus as described in claim 1 wherein said attachment componentry comprises flange supported protrusions at said second panel side of said first panel, each of said flange supported protrusions having a first aperture and a protrusion shape and protrusion size, and second apertures at said third panel side of said first panel, for receiving flange supported protrusions of said third panel, said second apertures being at least of said protrusion size.

3. The fluid containment apparatus as described in claim 2 wherein said first apertures of said first panel are sized and positioned on said flange supported protrusions so as to receive a pin when said flange supported protrusions of said first panel are established in second apertures of said second panel.

4. The fluid containment apparatus as described in claim 2 wherein said flange supported protrusions define driven pin axes in a vertical plane.

5. The fluid containment apparatus as described in claim 4 wherein at least one of said driven pin axes is off-vertical.

6. The fluid containment apparatus as described in claim 4 further comprising pins for driving through said first apertures of said first panel when said flange supported protrusions of said first panel are established in said second apertures of said second panel.

7. The fluid containment apparatus as described in claim 2 wherein outer edges of at least one of said flange supported protrusions define a stabilizing protrusion shape in said vertical plane.

8. The fluid containment apparatus as described in claim 7 wherein at least one of said second apertures defines a stabilizing aperture shape that corresponds with said stabilizing protrusion shape, and is located so as to stabilize at least one of said flange supported protrusions of said third panel having said stabilizing protrusion shape, when said flange supported protrusions of said third panel are established in said second apertures of said first panel and said third panel is attached to said first panel.

9. The fluid containment apparatus as described in claim 2 wherein said flange supported protrusions extend from said at least one retreating flange.

10. The fluid containment apparatus as described in claim 9 wherein said second apertures are in said at least one advancing flange.

11. The fluid containment apparatus as described in claim 2 wherein said flange supported protrusions extend from said at least one advancing flange.

12. The fluid containment apparatus as described in claim 11 wherein said second apertures are in said at least one retreating flange.

13. The fluid containment apparatus as described in claim 1 wherein said attachment componentry comprises flange supported protrusions at said third panel side of said first panel, each of said flange supported protrusions having a first aperture and a protrusion shape and protrusion size, and second apertures at said second panel side of said first panel, for receiving flange supported protrusions of said second panel, said second apertures being at least of said protrusion size.

14. The fluid containment apparatus as described in claim 13 wherein said first apertures of said first panel are sized and positioned on said flange supported protrusions so as to receive a pin when said flange supported protrusions of said first panel are established in second apertures of said third panel.

15. The fluid containment apparatus as described in claim 13 wherein said flange supported protrusions define driven pin axes in a vertical plane.

16. The fluid containment apparatus as described in claim 15 wherein at least one of said driven pin axes is off-vertical.

17. The fluid containment apparatus as described in claim 15 further comprising pins for driving through said first apertures of said first panel when said flange supported protrusions of said first panel are established in said second apertures of said third panel.

18. The fluid containment apparatus as described in claim 13 wherein outer edges of at least one of said flange supported protrusions define a stabilizing protrusion shape in said vertical plane.

19. The fluid containment apparatus as described in claim 18 wherein at least one of said second apertures defines a stabilizing aperture shape that corresponds with said stabilizing protrusion shape, and is located so as to stabilize at least one of said flange supported protrusions of said second panel having said stabilizing protrusion shape, when said flange supported protrusions of said second panel are established in said second apertures of said first panel and said second panel is attached to said first panel.

20. The fluid containment apparatus as described in claim 13 wherein said second apertures are larger than said protrusion size.

21. The fluid containment apparatus as described in claim 13 wherein said flange supported protrusions extend from said at least one retreating flange.

22. The fluid containment apparatus as described in claim 21 wherein said second apertures are in said at least one advancing flange.

23. The fluid containment apparatus as described in claim 13 wherein said flange supported protrusions extend from said at least one advancing flange.

24. The fluid containment apparatus as described in claim 23 wherein said second apertures are in said at least one retreating flange.

25. The fluid containment apparatus as described in claim 1 wherein said plurality of panels comprise at least 6 panels.

26. The fluid containment apparatus as described in claim 25 wherein said plurality of panels comprise at least 12 panels.

27. The fluid containment apparatus as described in claim 26 wherein said plurality of panels comprise at least 16 panels.

28. The fluid containment apparatus as described in claim 1 wherein said second panel is attached clockwise of said first panel and said third panel is attached counter-clockwise of said first panel.

29. The fluid containment apparatus as described in claim 1 wherein said second panel is established counter-clockwise of said first panel and said third panel is established clockwise of said first panel.

30. The fluid containment apparatus as described in claim 1 wherein said at least one retreating flange comprises a plurality of retreating flanges.

31. The fluid containment apparatus as described in claim 30 wherein said plurality of retreating flanges comprises one retreating flange for each of said flange supported protrusions.

32. The fluid containment apparatus as described in claim 1 wherein said at least one retreating flange comprises only one flange.

33. The fluid containment apparatus as described in claim 1 wherein said at least one advancing flange comprises only one advancing flange.

34. The fluid containment apparatus as described in claim 1 wherein said acute angle of x degrees comprises an angle selected from the group consisting of substantially 40 degrees, substantially 38 degrees, substantially 35 degrees, substantially 32 degrees, substantially 30 degrees and substantially 28 degrees.

35. The fluid containment apparatus as described in claim 1 wherein said first panel fluid containment component has a fluid containment component shape in a horizontal plane, wherein said fluid containment component shape is selected from the group of shapes consisting of: curved, arcuate, and straight.

36. The fluid containment apparatus as described in claim 35 wherein said flange supported protrusions extend from said at least one retreating flange.

37. The fluid containment apparatus as described in claim 36 wherein said second apertures are in said at least one advancing flange.

38. The fluid containment apparatus as described in claim 35 wherein said flange supported protrusions extend from said at least one advancing flange.

39. The fluid containment apparatus as described in claim 38 wherein said second apertures are in said at least one retreating flange.

40. The fluid containment apparatus as described in claim 1 wherein said attachment componentry comprises a plurality of sets of attachment components, said plurality of sets of attachment components comprises a lowest set, a second lowest set and remaining sets, and wherein a first vertical distance between at least one of said remaining sets and a second of said plurality of sets that is adjacent and lower than said at least one of said remaining sets is greater than a second vertical distance between said second of said plurality of sets and a third set that is adjacent and lower than said second of said plurality of sets, wherein said second vertical distance is greater than said third vertical distance between the third set and a fourth set that is adjacent and lower than the third set, and wherein said first vertical distance divided by said second vertical distance is a first ratio, said second vertical distance divided by said third vertical distance is a second ratio, and said first ratio and said second ratio are greater than one and substantially equal.

41. The fluid containment apparatus as described in claim 1 wherein said fluid containment apparatus is a hydraulic fracturing fluid containment apparatus.

42. A panel configured for side-to-side attachment with other panels to form an annular fluid containment structure, wherein:

during operation of said annular fluid containment structure, said panel is a first panel that is established between a second panel and a third panel, said first panel contacts said second panel at a first sealing contact surface on a second panel side of said first panel, and contacts said third panel at a second sealing contact surface on a third panel side of said first panel, said first panel comprising:

a first panel fluid containment component substantially between said first sealing contact surface and said second sealing contact surface, at least one retreating flange forming a part of said first panel and established at said second panel side thereof, wherein a fluid proximate part of said at least one retreating flange defines, in a horizontal plane, a line that forms a first angle with a first panel side of a line that is tangent to said first and second panels and that passes through a fluid proximate portion of said first sealing contact surface, wherein said first angle is an acute angle of x degrees;

at least one advancing flange forming a part of said first panel and established at said third panel side thereof, wherein a fluid proximate part of said at least one advancing flange defines, in a horizontal plane, a line that forms a second angle with a first panel side of a line that is tangent to said first and third panels and that passes through a fluid proximate portion of said second sealing contact surface, wherein said second angle is an obtuse angle of at most 180 degrees minus said x degrees;

further comprising attachment componentry for enabling attachment of said first panel against said second panel at said first sealing contact surface and attachment of said first panel against said third panel at said second sealing contact surface.

* * * * *